US006569586B2

(12) United States Patent
Itami et al.

(10) Patent No.: US 6,569,586 B2
(45) **Date of Patent: *May 27, 2003**

(54) PHOTORECEPTOR FOR FORMING ELECTROSTATIC LATENT IMAGE

(75) Inventors: Akihiko Itami, Tokyo (JP); Satoshi Uchino, Tokyo (JP); Fumitaka Mochizuki, Tokyo (JP); Kazuhisa Shida, Tokyo (JP); Takeo Ohshiba, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/981,217

(22) Filed: Oct. 15, 2001

(65) Prior Publication Data

US 2002/0076631 A1 Jun. 20, 2002

(30) Foreign Application Priority Data

Oct. 16, 2000 (JP) ..... 2000-314952
Feb. 13, 2001 (JP) ..... 2001-035234
Feb. 21, 2001 (JP) ..... 2001-044767
Feb. 27, 2001 (JP) ..... 2001-052035

(51) Int. Cl.[7] ..... G03G 5/087
(52) U.S. Cl. ..... 430/58.2; 430/96
(58) Field of Search ..... 430/58.2, 65, 66, 430/69, 96, 970

(56) References Cited

U.S. PATENT DOCUMENTS 6,258,499 B1 * 7/2001 Itami ..... 430/66
6,265,122 B1 * 7/2001 Itami et al. ..... 430/58.2
6,399,262 B1 * 6/2002 Oshiba et al. ..... 430/66

* cited by examiner

*Primary Examiner*—John Goodrow
(74) *Attorney, Agent, or Firm*—Cameron Kerrigan; Squire, Sanders & Dempsey, L.L.P.

(57) ABSTRACT

A photoreceptor for forming an electrostatic latent image is disclosed. The photoreceptor comprises a photosensitive layer and a resin layer wherein a resin of the resin layer comprises an organic polymer component, siloxane component and charge transportable component.

17 Claims, 1 Drawing Sheet

PHOTORECEPTOR FOR FORMING ELECTROSTATIC LATENT IMAGE

FIELD OF THE INVENTION

This invention relates to an electrophotographic photoreceptor, a producing method of the electrophotographic photoreceptor and an image forming method, an image forming apparatus and a processing cartridge each using the electrophotographic photoreceptor.

BACKGROUND OF THE INVENTION

Recently, an organic electrophotographic photoreceptor containing an organic photoconductive substance is most widely used as an electrophotographic photoreceptor. The organic photoreceptor is more advantageous than with another photoreceptor since a photoreceptor sensitive to light within the range of visible lays to infrared lays can be easily developed, a material without environment pollution can be chosen and the photoreceptor can be produced with a low price. However the organic photoreceptor has drawbacks such that a mechanical strength thereof is low, deterioration of the surface properties and a formation of scratches on the surface are tend to be occurred when the photoreceptor is repeatedly used for making many copies or prints.

Many investigations have been carried out to satisfy the various properties such as the above-mentioned.

It has been strongly demanded to inhibit the abrasive wear of the photoreceptor caused by rubbing by a cleaning blade for improving the durability of the organic photoreceptor. As an approach to such the improvement, a technique such that a resin layer having a high mechanical strength is provided on the surface or the photoreceptor has been investigated. For example, Japanese Patent Publication Open to Public Inspection, hereinafter referred to as JP O.P.I., No. 6-118681 discloses the use of a colloidal silica-containing hardenable siloxane as the surface layer of the photoreceptor. However, problems such as formation of crack, degradation of the adhesiveness to the photosensitive layer and deterioration of the electrostatic property of the photosensitive layer are caused by the use of the resin layer only composed of silica structured by repeating three dimensional siloxane, Si—O—Si, bonds.

An inorganic-organic hybrid polymer having both properties of an organic polymer and a cross-linked siloxane component has been proposed as a trial of improvement of adhesiveness with the photosensitive layer and the anti-wearing property of the resin layer. For example, JP O.P.I. No. 2000-221723 discloses a resin layer containing a polymer composed of a chemical combined product of polysiloxane and silyl group-containing vinyl resin. However, a photoreceptor having such the resin layer is insufficient as a photoreceptor for the most widely used electrophotographic method such as a Carlson process since the electrophotographic property is insufficient and fog and blur of image are tend to be occurred when the photoreceptor is repeatedly used even though the wearing resistively of the photoreceptor is improved.

The inventors have proposed, Japanese Patent Application No. 1-70308, a layer of a siloxane resin having an electric charge transporting property providing group and a cross-linked structure for the resin layer of the photoreceptor satisfying both of the mechanical wearing resistively and the electrophotographic property at the repeatedly using. The photoreceptor having such the resin layer is practically useful as an organic photoreceptor with a high durability since the photoreceptor is improved in the wearing resistively and the electrophotographic property such as the charging ability, photosensitivity and charge remaining property at repeatedly using which are important problems of the usual photoreceptor. However, such the resin layer is become a layer behaving as a strong elastic substance since a highly cross-linked resin peculiar to the siloxane resin is formed in such the resin layer. Therefore, the torque between the photoreceptor and a cleaning blade is increased, when a cleaning device using a cleaning blade is used, problems such as the instability of the cleaning suitability of toner and the turn over of the cleaning blade are tend to be often occurred. Moreover, is found a problem that the resolving power of image formed on the photoreceptor is considerably lowered under a high humid condition compared with usual photoreceptors.

SUMMARY OF THE INVENTION

The object of the invention is to provide a high durable electrophotographic photoreceptor improved in the resistively to the abrasive wearing caused by rubbing by a cleaning blade and the electrophotographic properties such as the charging ability, photosensitivity and the charge remaining property, and a photoreceptor having a resin layer which is superior in the stability to the cleaning property of toner and the turn over of cleaning blade, furthermore, to provide a photoreceptor by which a sharp image can be obtained under a high humid condition. Further object of the invention is to provide a producing method of the photoreceptor, an image forming method, an image forming apparatus and a processing cartridge each using the photoreceptor.

The invention is described.

The photoreceptor of the invention comprises a support and, provided thereon, a photosensitive layer and a resin layer wherein the resin of the resin layer comprises an organic polymer component, siloxane component and charge transportable component.

The resin preferably composed of organic polymer skeleton (main chain) and the siloxane component and charge transportable component at side chain of the skeleton.

The organic polymer may comprise an anti-oxidant component, preferably at side chain of the skeleton.

The organic polymer may have an epoxy group or an open ring group thereof, preferably at the chain of the skeleton, more preferably in the siloxane component.

The organic polymer may have a fluorine atom, which may be incorporated in the polymer skeleton or at the side chain thereof.

DETAILED DESCRIPTION OF THE INVENTION

Figure 1:
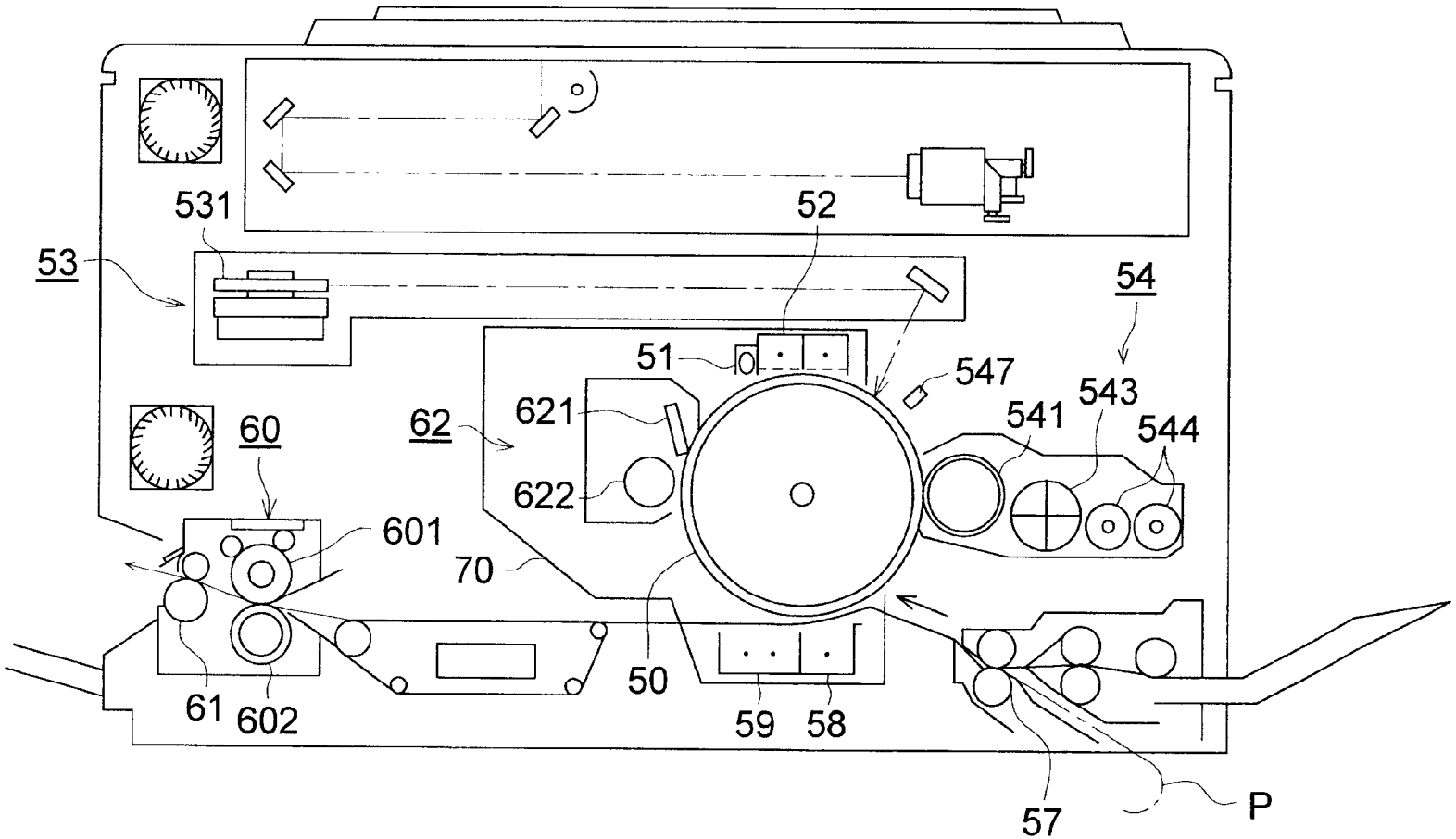
FIG. 1 is an example of image forming apparatus to which the photoreceptor of the invention is applied.

The invention is described in detail.

The resin layer according to the invention contains a polymer containing a polymer component, a condensed siloxane component and a charge transportable structural component.

The polymer component is, preferably a thermoplastic polymer, and a resin component having a main skeleton constituted by a repeating unit of a thermoplastic monomer unit. The thermoplastic monomer unit is a monomer unit composing thermoplastic resin component, example of which includes a polymer component constituting a vinyl resin, a polyester resin or a polycarbonate resin. The thermoplastic polymer component is unitized by chemical bond with condensed siloxane component and the charge transportable structural component in the resin according to the invention. The chemical bonding includes covalent bond generated by chemical reaction, hydrogen bond and ionic bond.

The organic polymer component may have an anti-oxidizing structural component such as a hindered amine or a hindered phenol and unitized by chemical bond with the condensed siloxane component and the charge transportable structural component. The chemical bond includes a covalent bond, a hydrogen bond and an ionic bond. The anti-oxidizing structural component is a group having a resistively to oxidation or reduction caused by an active gas such as ozone and NOx, or irradiation of ultra-violet rays.

The above-mentioned resin structure can be obtained by forming an organic polymer having the anti-oxidation structural component and a silyl group using a polymerizable monomer capable of participating in the polymerization reaction, a monomer having the anti-oxidation structural component and a polymerizable silane compound, and by forming a siloxane condensate having the charge transportable structure to the silyl group of the organic polymer obtained as above.

In the following description, a vinyl polymer is used as the organic polymer component.

In the invention, the vinyl polymer component having the anti-oxidation structural component is a vinyl polymer which has a group having an anti-oxidation function as the partial structure thereof. The anti-oxidation component preferably used in the invention includes a hindered amine group and a hindered phenol group.

The hindered amine group is a group or a derivative having steric hindrance near the nitrogen atom of an amino group of an amino compound. A branched alkyl group having three or more carbon atoms is preferred as the group having the steric hindrance.

The hindered phenol group is a group having the steric hindrance at the ortho-position with respect to the hydroxyl group of the phenol, provided that the hydroxyl group may be modified to an alkoxyl group. A branched alkyl group having three or more carbon atoms is preferred as the group with the steric hindrance.

The hindered amine group or the hindered phenol group can be introduced in the vinyl polymer component as the partial structure of the polymer by co-existing a hindered amine monomer or a hindered phenol monomer each having a polymerizable unsaturated group including an unsaturated carbon—carbon bond at the time of polymerization of the vinyl polymer so as to react the monomer with the progress of the polymerization of the vinyl polymer.

A amine monomer with steric hindrance including a polymerizable unsaturated group is preferred as such the hindered amine monomer having the polymerizable unsaturated group. A piperidine compound with steric hindrance having a polymerizable unsaturated group, hereinafter referred to as piperidine monomer, is particularly preferred. Typical examples of the piperidine monomer include compounds each represented by the following Formula A.

Formula A

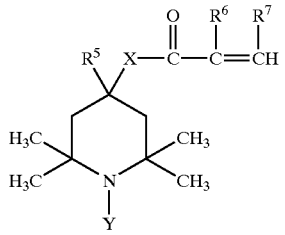

In Formula A, $R^5$ is a hydrogen atom or a cyano group, $R^6$ and $R^7$ are each a hydrogen atom, a methyl group or an ethyl group, $R^6$ and $R^7$ may be the same or different from each other, X is an oxygen atom or an imino group, Y is a hydrogen atom, an alkyl group having from 1 to 18 carbon atoms or a polymerizable unsaturated group represented by the following Formula B.

Formula B

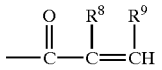

In Formula B, $R^8$ and $R^9$ are each a hydrogen atom, a methyl group or an ethyl group which may be the same or different from each other.

In Formula A, a hydrogen atom of the imino group represented by X may be unsubstituted or substituted. Examples of the alkyl group having from 1 to 18 carbon atoms represented by Y in Formula A include a linear- and branched-alkyl groups such as a methyl group, an ethyl group, an n-propyl group, an iso-propyl group, an n-butyl group, an iso-butyl group, a sec-butyl group, a t-butyl group, an n-pentyl group, n n-hexyl group, an n-heptyl group, an n-octyl group, an n-nonyl group, an n-decyl group, an n-undecyl group, an n-dodecyl group, an n-tetradecyl group, an n-pentadecyl group, an n-hexadecyl group, an n-heptadecyl group and an n-octadecyl group.

Preferable examples of the piperidine monomer represented by Formula A include 4-(metha)acryloyloxy-2,2,6,6-tetramethylpiperidine, 4-(metha)acryloylamino-2,2,6,6-tetramethylpiperidine, 4-(metha)acryloyloxy-1,2,2,6,6-pentamethylpiperidine, 4-(metha)acryloyl-amino-1,2,2,6,6-pentamethylpiperidine, 4-cyano-4-(metha)acryloyloxy-2,2,6,6-tetramethylpiperidine, 4-cyano-4-(metha)acryloylamino-2,2,6,6-tetramethylpiperidine, 4-cyano-4-(metha)acryloyloxy-1,2,2,6,6-pentamethylpiperidine, 4-cyano-4-(metha)acryloylamino-1,2,2,6,6-pentamethylpiperidine, 1-(metha)acryloyl-4-(metha)acryloyloxy-2,2,6,6-tetramethylpiperidine, 1-(metha)aclyloyl-4-(metha)acryloylamino-2,2,6,6-tetramethylpiperidine, 1-(metha)aclyloyl-4-cyano-4-(metha)acryloyloxy-2,2,6,6-tetramethylpiperidine, 1-(metha)aclyloyl-4-cyano-4-(metha)acryloylamino-2,2,6,6-tetramethylpiperidine, 4-crotonoyloxy-2,2,6,6-tetramethylpiperidine, 4-crotonoylamino-2,2,6,6-tetramethylpiperidine, 4-crotonoyloxy-1,2,2,6,6-pentamethylpiperidine, 4-crotonoylamino-1,2,2,6,6-pentamethylpiperidine, 4-cyano-4-crotonoyloxy-2,2,6,6-tetramethylpiperidine, 4-cyano-4-crotonoylamino-2,2,6,6-tetramethylpiperidine, 1-crotonoyl-4-crotonoyloxy-2,2,6,6-tetramethylpiperidine, 1-crotonoyl-4-crotonoylamino -2,2,6,6-tetramethylpiperidine, 1-crotonoyl-4-cyano-4-crotonoyloxy-2,2,6,6-tetramethylpiperidine and 1-crotonoyl-4-cyano-4-crotonoylamino-2,2,6,6-tetramethylpiperidine. Among them, 4-(metha)acryloyloxy-2,2,6,6-tetramethylpiperidine and 4-(metha)acryloyloxy-1,2,2,6,6-pentamethylpiperidine are particularly preferred.

Hindered phenol monomers each having a polymerizable unsaturated group is preferably used as the hindered phenol monomer. Examples of the hindered phenol monomer include the followings; 2-t-butyl-6-(3-t-butyl-2-hydroxy-5-methylbenzyl)-4-methylphenyl acrylate, 2-(3,5-di-t-butyl-4-hydroxyphenyl)ethyl acrylate, 2-(3,5-di-s-propyl-4-hydroxyphenyl)ethyl acrylate, 2-(3,5-di-t-octyl-4-hydroxyphenyl)ethyl acrylate, 2-{3-t-butyl-5-(3-t-butyl-2-hydroxy-5-methylbenzyl4-hydroxyphenyl}ethyl acrylate, 2-t-butyl-6-(3-t-butyl-2-hydroxy-5-methylbenzyl)-4-methylphenyl (metha)acrylate, 2-(3,5-di-t-butyl-4-hydroxyphenyl)ethyl (metha)acrylate, 2-(3,5-di-s-propyl-4-hydroxyphenyl)ethyl (metha)acrylate, 2-(3,5-di-t-octyl-4-hydroxyphenyl)ethyl (metha)acrylate, 2-(3-t-butyl-5-{3-t-butyl-2-hydroxy-5-methylbenzyl}4-hydroxyphenylethyl (metha)acrylate, vinyl 3,5-di-t-butyl-4-hydrozyphenylpropionate, vinyl 3,5-di-t-octyl-4-hydrozyphenylpropionate, iso-propenyl 3,5-di-t-butyl-4-hydrozyphenylpropionate and iso-propenyl 3,5-di-t-octyl-4-hydrozyphenylpropionate.

Examples of monomer other than the foregoing hindered amine and the hindered phenol monomers include salicylic acid compound such as phenyl salicylic acid (metha)acrylate and t-butylphenylsalicylic acid (mtha)acrylate; benzophenone compounds such as 2-(metha)acryloyloxy-4-methoxybenzophenone, 2-(metha)acryloyloxy-2'-hydroxy-4-methoxybenzophenone, 2,2'-di(metha)acryloyloxy-4-methoxybenzophenone, 2,2'-di(metha)acryloyloxy-4,4'-dimethoxybenzophenone, 2-(metha)acryloyloxy-4-methoxy-2'-carboxybenzophenone, 2-hydroxy-4-[3-(metha)acryloyloxy-2-hydroxypropoxy]-benzophenone and 2,2'-dihydroxy-4-[3-(metha)acryloyloxy-2-hydroxypropoxy]benzophenone; benzotriazole compounds such as 2-[2'-(metha)acryloyloxy-5'-methylphenyl]benzotriazole, 2-[2'-(metha)acryloyloxy-5'-t-octylphenyl]benzotriazole and 2-[2'-(metha)acryloyloxy-3',5'-di-t-butylphenyl]-benzotriazole; 2-ethylhexyl-2-cyano-3,3-diohenyl (metha)acrylate, 1,3-bis(4-benzoyl-3-hydroxyphenoxy)-2-propyl (metha)acrylate and ethyl-2-cyano-3,3-diohenyl (metha)acrylate. In the invention, the monomers each having the anti-oxidation component may be used singly or in combination.

The thermoplastic polymer component can be introduced into the resin by employing a vinyl resin comprising silyl group at the side chain of the thermoplastic polymer component, or a vinyl resin having formed condensed siloxane component at the side chain.

The vinyl resin having condensed siloxane component in the side chain can be obtained by reacting the vinyl resin having silyl group in the side chain described below with the organic silicon compound described later.

The preparation of the vinyl resin comprising silyl group according to the invention is not specifically restricted. For example, silyl group can be introduced after preparation of the vinyl resin, or a vinyl compound comprising silyl group can be polymerized with various vinyl compound. In detail, the vinyl resin comprising silyl group can be prepared by (a) reacting a hydroxy silane compound with a vinyl compound having carbon—carbon double bond, or (b) polymerizing a silane compound represented by Formula (1) with vinyl compound.

Formula (1)

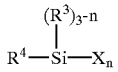

In the formula $R^3$ is an alkyl having carbon atoms of from 1 to 10 or an aralkyl having carbon atoms of from 1 to 10, $R^4$ is an organic group having polymerizable double bond, X is a halogen atom, an alkoxy, acyloxy, aminooxy or phenoxy group, n is an integer of from 1 to 3.

The hydroxy silane compound employing in preparation method (a) includes halogenated silane such as methyl dichlorosilane, trichlorosilane, phenyldichlorosilane; alkoxysilane such as methyl diethoxy silane, methyl dimethoxy silane, phenyl dimethoxy silane, trimethoxysilane, triethoxysilane; acetoxy silane such as methyl diacetoxy silane, phenyl diacetoxy silane, triacetoxy silane; aminosilane such as methyl di aminooxy silane, tri aminooxy silane, dimethyl aminooxy silane, triamino silane.

The hydroxy silane compound can be employed singly or plurally in combination.

The vinyl resin employed in the preparation method (a) is not restricted as far as it does not contain hydroxy group, and its example includes a polymer and a copolymer of one or more monomers selected from the group consisting of, for example, (metha)acrylic acid esters such as methyl (metha)acrylate, ethyl (metha)acrylate, butyl (metha)acrylate, 2-ethylhexyl (metha)acrylate and cyclohexyl (metha)acrylate; carboxylic acids such as itaconic acid and fumaric acid and acid anhydrides such as maleic anhydride; epoxy compounds such as glycidyl (metha)acrylate; amino compounds such as diethylaminoethyl (metha)acrylate and aminoethyl vinyl ether; amide compound such as (metha)acrylamide, itaconyl diamide, α-ethylacrylamide, crotonylamide, fumaryldiamide, maleinyldiamide and N-butoxymethyl(metha)acrylamide; acrylonitrile, styrene, α-methylstyrene, vinyl chloride, vinyl acetate and vinyl propionate. Vinyl monomers each having a hydroxyl group such as 2-hydroxyethyl (metha)acrylate, 2-hydroxypropyl (metha)acrylate, 2-hydroxy vinyl ether and N-methylolacrylamide.

Such as $CH_2{=}CHSi(CH_3)(OCH_3)_2$, $CH_2{=}CHSi(OCH_3)_3$, $CH_2{=}CHSi(OCH_3)Cl_2$, $CH_2{=}CHSiCl_3$, $CH_2{=}CHCOO(CH_2)_2Si(CH_3)(OCH_3)_2$, $CH_2{=}CHCOO(CH_2)_2Si(OCH_3)_3$, $CH_2{=}CHCOO(CH_2)_3Si(CH_3)(OCH_3)_2$, $CH_2{=}CHCOO(CH_2)_3Si(OCH_3)_3$, $CH_2{=}CHCOO(CH_2)_2Si(CH_3)Cl_2$, $CH_2{=}CHCOO(CH_2)_2SiCl_3$, $CH_2{=}CHCOO(CH_2)_3Si(CH_3)Cl_2$, $CH_2{=}CHCOO(CH_2)_3SiCl_3$, $CH_2{=}C(CH_3)COO(CH_2)_2Si(CH_3)(OCH_3)_2$, $CH_2{=}C(CH_3)COO(CH_2)_2Si(OCH_3)_3$, $CH_2{=}C(CH_3)COO(CH_2)_3Si(CH_3)(OCH_3)_2$, $CH_2{=}C(CH_3)COO(CH_2)_3Si(OCH_3)_3$, $CH_2{=}C(CH_3)COO(CH_2)_2Si(CH_3)Cl_2$, $CH_2{=}C(CH_3)COO(CH_2)_2SiCl_3$, $CH_2{=}C(CH_3)COO(CH_2)_2Si(CH_3)Cl_2$, $CH_2{=}C(CH_3)COO(CH_2)_3Si(CH_3)Cl_2$, and $CH_2{=}C(CH_3)COO(CH_2)_3SiCl_3$.

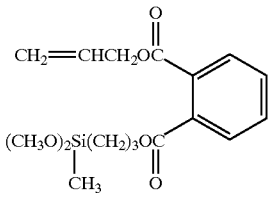

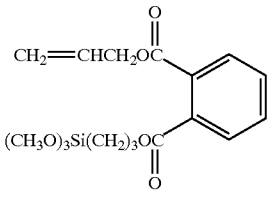

-continued

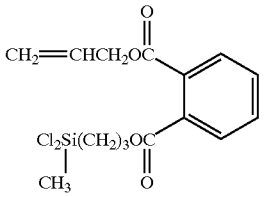

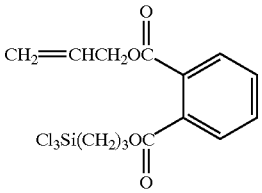

The silane compound can be employed singly or plurally in combination.

Vinyl compound which is illustrated for those employed in the preparation method (a) can be employed in the preparation method (b). In addition thereto vinyl compounds containing hydroxy group, such as 2-hydroxyethyl (meta) acrylate, 2-hydroxypropyl (meta) acrylate, 2-hydroxy vinyl ether, N-methylolacrylamide and so on can be available. The vinyl compound can be employed singly or plurally in combination.

Synthesizing Example of Resin Containing Silyl group (1A)

Sixty five parts of methyl methacrylate, 35 parts of n-butyl methacrylate, 20 parts of γ-methacryloyloxypropyltrimethoxysilane (KBM 503, product by Shin-Etsu Chemical Co., Ltd.), 10 parts of N-methylol acrylamide and 6 parts of acrylic acid as monomers are dissolved in 130 parts of isopropyl alcohol. The mixture was heated by 80° C. while stirring. A solution of 4 parts of azo-bis-iso-valeronitrile dissolved in 10 parts of tetrahydrofuran was dropped into the mixture. Vinyl resin containing silyl group 1A with a solid content of 50% was obtained after reaction for 4 hours. Synthesizing example of resin containing silyl group (1B) Sixty five parts of methyl methacrylate, 35 parts of n-butyl acrylate, 20 parts of γ-methacryloyloxypropyltrimethoxysilane (KBM 503, product by Shin-Etsu Chemical Co., Ltd.), 10 parts of N-methylol acrylamide and 6 parts of acrylic acid as monomers are dissolved in 130 parts of isopropyl alcohol. The mixture was heated by 80° C. while stirring. A solution of 4 parts of azo-bis-iso-valeronitrile dissolved in 10 parts of xylene was dropped into the mixture. Vinyl resin containing silyl group 1B with a solid content of 50% was obtained after reaction for 4 hours.

Synthesizing examples of the silyl-modified vinyl polymer having a hindered amine group or a hindered phenol group are described below.

(Synthesizing Example of Vinyl Polymer Solution 2A: a Solution of Silyl-modified Vinyl Polymer having a Hindered Amine Group)

Twenty five parts of γ-methacryloyloxypropyltrimethoxysilane as a monomer, 1 part of 4-methacryloyloxy-1,2,2,6,6-pentamethylpiperidine, 80 parts of methyl methacrylate, 15 parts of 2-ethylhexyl methacrylate, 29 parts of n-butyl methacrylate, 150 parts of 2-propanol, 50 parts of n-butanone and 25 parts of methanol were put and mixed in a reaction vessel having a reflux condenser and a stirrer. The mixture was heated by 80° C. while stirring. A solution of 4 parts of azo-bis-iso-valeronitrile dissolved in 10 parts of xylene was dropped into the mixture spending 30 minutes. Solution A with a solid content of 40% of a vinyl polymer having a silyl group and a hindered amine group in the side chain was obtained after reaction for 5 hours at 80°.

(Synthesizing Example of Vinyl Polymer Solution 2B: a Solution of Silyl-Modified Vinyl Polymer Having a Hindered Phenol Group)

Twenty parts of γ-methacryloyloxypropyltrimethoxysilane as a monomer, 2 parts of 2-t-butyl-6-(3-t-butyl-2-hydroxy-5-methylbenzyl-4-methylphenyl acrylate , 70 parts of methyl methacrylate, 40 parts of n-butyl methacrylate, 5 parts of methacrylic acid, 13 parts of 2-hydroxyethyl methacrylate, 1 part of 1,1,1-trimethyl-aminemethacrylimide, 150 parts of 2-propanol, 50 parts of 2-butanone and 25 parts of methanol were put and mixed in a reaction vessel having a reflux condenser and a stirrer. The mixture was heated by 80° C. while stirring. A solution of 4 parts of azo-bis-iso-valeronitrile dissolved in 10 parts of xylene was dropped into the mixture spending 30 minutes. Solution B with a solid content of 40% of a vinyl polymer having a silyl group and a hindered phenol group in the side chain was obtained after reaction for 5 hours at 80°.

As described in the above Synthesizing Examples 2A and 2B, the vinyl polymer having a hindered amine group or a hindered phenol group in the side chain thereof and a silyl group can be synthesized by polymerizing a hindered amine monomer, hindered phenol monomer, silane monomer and a vinyl monomer each having a polymerizable unsaturated group.

Although there is no limitation on the polymerization degree of the silyl-modified vinyl polymer, the polymerization degree is preferably from 100 to 500.

A resin having the structure according to the invention can be prepared by forming a siloxane condensate component having a charge transportable structure on the silyl-modified vinyl polymer. Namely, the siloxane condensate is formed at a silyl group of the silyl-modified vinyl polymer by using the silyl-modified vinyl polymer having the hindered amine group or the hindered phenol group and the following organic silicon compound. The formation of the siloxane condensate component may be carried out at the period of formation or resin layer or by the procedure that the condensate is previously formed at the terminal of the silyl group in the resin solution and then the resin layer is formed.

In the invention, "having the hindered amine group or the hindered phenol group" means that the resin has at least one of the hindered amine group and the hindered phenol group. The resin may have both of the groups.

A synthesizing example of vinyl polymer having a silyl group and a fluorine-containing vinyl group is described below.

The following monomers and solvents were put and mixed to dissolve in a reaction vessel having a reflux condenser and a stirrer. Then heated by 80° C. while stirring.

| | |
|---|---|
| Monomers: | |
| γ-methacryloyloxypropyltrimethoxysilane | 25 parts by weight |
| 2,2,2-trifluoroethyl methacrylate | 35 parts by weight |
| Methyl methacrylate | 60 parts by weight |
| n-butyl acrylate | 29 parts by weight |
| 4-methacryloyloxy-1,2,2,6,6-pentamethylpiperidine | 1 part by weight |
| Solvents: | |
| i-propyl alcohol | 150 parts by weight |
| Methyl ethyl ketone | 50 parts by weight |
| Methanol | 25 parts by weight |

A solution of 40 parts of azo-iso-bis-valeronitryl dissolved in 10 parts of xylene was dropped into the mixture spending 30 minutes. Then reaction was performed for 5 hours at 80° C. Thus Vinyl Polymer Solution A of a vinyl polymer having the fluorine-containing vinyl group and the silyl group was prepared. The solid content of the solution was 40% by weight.

The vinyl polymer having a fluorine-containing group in the side chain and a silyl group can be synthesized by polymerization of a mixture of a vinyl monomer having a polymerizable unsaturated group, a fluorine-containing vinyl monomer and a silane monomer as shown in the synthesizing example of Vinyl Polymer Solution A.

The weight ratio of the vinyl monomer to the fluorine-containing vinyl monomer in the foregoing vinyl polymer is preferably 1:0.01 to 2. When the weight ratio of the fluorine-containing vinyl monomer is less than 0.01, turn over of the cleaning blade tends to be occurred since the sliding ability of the resin layer is lowered. The weight ratio of the fluorine-containing vinyl monomer of more than 2 is more preferable since the strength of the resin layer is made weaker and the abrasive wear of the layer is increased, moreover the adhesiveness of the resin layer to the photosensitive lower layer is decreased.

The polymerization degree of the vinyl polymer is preferably from 100 to 500 even though there is no specific limitation.

The resin having the structure according to the invention can be formed by bonding the foregoing vinyl polymer with the siloxane component. Namely, the siloxane component is formed at the silyl group of the silyl-modified vinyl polymer using the vinyl polymer having the fluorine-containing group and the following organic silicon compound. The formation of the siloxane component at the terminal of the silyl group of the vinyl polymer may be carried out in the resin solution previous the rein layer formation even though the siloxane component may be carried out at the same time of the formation of the resin layer. Moreover, the siloxane component may be previously formed.

The vinyl resin having condensed siloxane component in the side chain can be obtained by reacting the vinyl resin having silyl group in the side chain mentioned above with the following organic silicon compound.

Degree of the polymerization of the vinyl resin having silyl group employed in the invention is preferably from 10 to 500.

The condensed siloxane component has three dimensional structure composed of plural siloxane bonds, and has structure of polymer condensation of organic silicon compound as represented by formula (2).

$$R_nSi(Z)_{4-n} \qquad \text{Formula (2)}$$

In the formula, R is an organic group having carbon atom through which bonds directly to silicon atom shown in the formula, Z is hydroxy group or hydrolizable group, n is an integer of from 1 to 3.

Z in the above formula (2) is a hydrolyzable group, examples thereof include a methoxy group, an ethoxy group, a methylethyl ketoxime group, a diethylamino group, an acetoxy group, a propenoxy group, a propoxy group, a butoxy group and a methoxyethoxy group. Example of the organic group represented by R in each of which a carbon atom is directly bonded to the silicon atom, include an alkyl group such as a methyl group, an ethyl group, a propyl group and a butyl group, an aryl group such as a phenyl group, a tolyl group, a naphthyl group and a biphenyl group, an epoxy-containing group such as a γ-glycidoxypropyl group and a β-(3,4-epoxycyclohexyl)ethyl group, an (metha) acryloyl-containing group such as a γ-acryloxypropyl group and a γ-methacryloxypropyl group, a hydroxyl-containing group such as a γ-hydroxypropyl group and a 2,3-dihydroxypropyloxypropyl group, a vinyl-containing group such as a vinyl group and a propenyl group, a mercapto-containing group such as a γ-mercaptopropyl group, an amino-containing group such as a γ-aminopropyl group and an N-β-(aminoethyl)-γ-aminopropyl group, a halogen-containing group such as a γ-chloropropyl group, an 1,1,1-trifluoropropyl group, a nonafluorohexyl group and perfluorooctylethyl group, and an alkyl group substituted by a nitro group or a cyano group. The organic groups represented by Rn may be the same as or different from each other when n is two or more.

The group represented by R of the organic silicon compound in the formula (2) may be the same as or different from each other when two or more silicon compounds are employed in preparing the siloxane resin according to the present invention.

The siloxane condensate may be formed by the use of a silane compound having at least an epoxy group or an open ring group thereof.

A layer of the resin according to the invention having the siloxane condensate formed by using the silane compound having the epoxy group or the open ring epoxy group improves the anti-wearing property of the electrophotographic receptor and prevents image blurring under a high humid and a low humid conditions when the layer is used as the surface layer of the electrophotographic receptor.

Examples of the silane compound having the epoxy group or the open ring epoxy group preferably used in the invention include (3-glycidoxypropyl)trimethoxysilane, 2-(3,4-epoxycyclohexyl)ethyltrimethoxysilane, 2-(3,4-epoxycyclohexyl)-ethyltriethoxysilane, 5,6-epoxyhexyltriethoxysilane, (3-glycidoxypropyl) methyldiethoxysilane, (3-glycidoxypropyl) methyldimethoxysilane, 2-(3,4-epoxy-cyclohexyl) ethylmethyldimethoxysilane, (3-glycidoxypropyl) dimethylethoxysilane and diethoxy-3-glycidoxypropylmethylsilane.

It is preferable for forming the siloxane condensate that the polycondensation is performed in the co-presence of a silane compound represented by the above mentioned Formula 2 other than the above-mentioned silane compound having the epoxy group or the open ring epoxy group.

Practical example of the organic silicon compound represented by formula (2) includes the following compounds.

Examples of compound n being zero include tetrachlorosilane, diethoxy dichlorosilane, tetramethoxy silane, phenoxy trichlorosilane, tetra acetoxy silane, tetraethoxysilane, tetraaryloxysilane, tetra propoxy silane, tetra isopropoxy silane, tetrakis(2-methoxyethoxy)silane, tetrabutoxy silane, tetraphenoxy silane, tetrakis(2-ethyl butoxy)silane and tetrakis(2-ethylhexyloxy)silane.

Examples of compound n being 1 include trichlorosilane, chloromethyl trichlorosilane, methyltrichlorosilane, 1,2-dibromo ethyltrichlorosilane, vinyltrichlorosilane, 1,2-dichloroethyl trichlorosilane, 1-chloroethyl trichlorosilane, 2-chloroethyl trichlorosilane, ethyltrichlorosilane, 3,3,3-trifluoro propyl trichlorosilane, 2-cyanoethyl trichlorosilane, allyltrichlorosilane, 3-bromopropyltrichlorosilane, chloromethyl trimethoxysilane, 3-chloropropyl trichlorosilane, n-propyl trichlorosilane, ethoxymethyl dichlorosilane, dimethoxymethyl chlorosilane, trimethoxysilane, 3-cyanopropyl trichlorosilane, n-butyl trichlorosilane, isobutyl trichlorosilane, chloromethyl triethoxysilane, methyltrimethoxysilane, mercaptomethyl trimethoxysilane, pentyl trichlorosilane, trimethoxy vinylsilane, ethyl trimethoxysilane, 3,3,4,4,5,5,6,6,6-nonafluorohexyl trichlorosilane, 4-chlorophenyl chlorosilane, phenyltrichlorosilane, cyclohexyl trichlorosilane, hexyl trichlorosilane, tris(2-chloroethoxy)silane, 3,3,3-trifluoro propyltrimethoxysilane, 2-cyanoethyl trimethoxysilane, triethoxy chlorosilane, 3-chloropropyl trimethoxysilane, triethoxysilane, 3-mercapto propyltrimethoxysilane, 3-aminopropyltrimethoxysilane, 2-aminoethylaminomethyl trimethoxysilane, benzyl trichlorosilane, p-tolyl trichlorosilane, 6-trichlorosilyl-2-norbornane, 2-trichlorosilyl norbornane, methyltriacetoxy silane, heptyl trichlorosilane, chloromethyl triethoxysilane, butyl trimethoxysilane, methyl triethoxysilane, methyltris(2-aminoethoxy) silane, 3-phenethyl trichlorosilane, triacetoxy vinylsilane, 2-(4-cyclohexylethyl)trichlorosilane, ethyl triacetoxy silane, 3-trifluoroacetoxy propyltrimethoxysilane, octyl trichlorosilane, triethoxyvinylsilane, ethyl triethoxysilane, 3-(2-aminoethylaminopropyl) trimethoxysilane, chloromethylphenylethyl trichlorosilane, 2-phenylpropyl trichlorosilane, 4-chlorophenyl trimethoxysilane, phenyltrimethoxysilane, nonyl trichlorosilane, 2-cyanoethyl triethoxysilane, allyl triethoxysilane, 3-allylthio propyltrimethoxysilane, 3-glycidoxy propyltrimethoxysilane, 3-bromo propyl triethoxysilane, 3-chloropropyl triethoxysilane, 3-arylamino propyltrimethoxysilane, propyl triethoxysilane, hexyl trimethoxysilane, 3-aminopropyl triethoxysilane, methyltriisopropenoxy silane, 3-methcryloxypropyl trimethoxysilane, decyltrichlorosilane, bis (ethylmethylketoxime) methoxymethyl silane, 3-morpholino propyltrimethoxysilane, 3-piperazino propyltrimethoxysilane, methyltripropoxy silane, methyltris (2-methoxyethoxysilane), 2-(2-aminoethylthioethyl) triethoxysilane, 3-[2-(2-aminoethylaminoethylamino) propyl] triethoxysilane, tris(1-methylvinyloxy)vinylsilane, 2-(3,4-epoxycyclohexylethyL) trimethoxysilane, triisopropoxyvinylsilane, tris(2-methoxyethoxy)vinylsilane, diisopropoxyethylmethylketoxime methylsilane, 3-piperidinopropyl trimethoxysilane, pentyl triethoxysilane, 4-chlorophenyl triethoxysilane, phenyltriethoxysilane, bis (ethylmethylketoxime)methylisopropoxy silane, bis (ethylmethyl ketoxime)-2-methoxyethoxy methylsilane, 3-(2-methylpiperidinopropyl)trimethoxysilane, 3-cyclohexyl aminopropyltrimethoxysilane, O,O'-diethyl-S-(2-triethoxysilylethyl)dithiophosphate, benzyl triethoxysilane, 6-triethoxysilyl-2-norbornane, 3-benzylamino propyltrimethoxysilane, methyltris (ethylmethylketoxime)silane, bis(ethylmethylketoxime) butoxymethyl silane, methyltris(N,N-diethylaminoxy) silane, tetradecyltrichlorosilane, octyl triethoxysilane, phenyltris(2-methoxyethoxy)silane, 3-(vinylbenzyl aminopropyl)trimethoxysilane, N-(3-triethoxysilylpropyl)-p-nitrobenzamide, 3-(vinylbenzyl aminopropyl) triethoxysilane, octadecyl trichlorosilane, dodecyl triethoxysilane, docosyl trichlorosilane, octadecyl triethoxysilane, dimethyloctadecyl-3-trimethoxylsilylpropylammonium chloride, 1,2-bis (methyldichlorosilyl)ethane.

Examples of compound n being 2 include chloromethylmethyl dichlorosilane, dimethyldichlorosilane, ethyldichlorosilane, methylvinyl dichlorosilane, ethylmethyl dichlorosilane, dimethoxymethyl silane, dimethoxy dimethylsilane, divinyl dichlorosilane, methyl-3,3,3-trifluoropropyl dichlorosilane, allylmethyldichlorosilane, 3-chloropropyl methyl dichlorosilane, diethyldichlorosilane, methylpropyldichlorosilane, diethoxysilane, 3-cyanopropylmethyl dichlorosilane, butylmethyl dichlorosilane, bis(2-chloroethoxy)methylsilane, diethoxy methylsilane, phenyl dichlorosilane, diallyl dichlorosilane, dimethoxymethyl-3,3,3-trifluoro propylsilane, methylpentyl dichlorosilane, 3-chloropropyl dimethoxymethylsilane, chloromethyl diethoxysilane, diethoxy dimethylsilane, dimethoxy-3-mercaptopropylmethylsilane, 3,3,4,4,5,5,6,6,6-nonafluorohexylmethyl dichlorosilane, methylphenyl dichlorosilane, diacetoxy methylvinylsilane, cyclohexylmethyl dichlorosilane, hexylmethyl dichlorosilane, diethoxy methylvinylsilane, hexylmethyl dichlorosilane, diethoxy methylvinylsilane, phenylvinyl dichlorosilane, 6-methyldichlorosilyl-2-norbornane, 2-methyldichlorosilyl norbornane, 3-methcryloxypropylmethyl dichlorosilane, diethoxydivinylsilane, heptylmethyl dichlorosilane, dibutyl dichlorosilane, diethoxydiethylsilane, dimethyldipropoxysilane, 3-aminopropyldiethoxy methylsilane, 3-(2-aminoethylaminopropyl) dimethoxymethylsilane, allylphenyl dichlorosilane, 3-chloropropylphenyl dichlorosilane, methyl-β-phenethyl dichlorosilane, dimethoxymethyl phenylsilane, 2-(4-cyclohexenylethyl)methyl dichlorosilane, methyloctyl dichlorosilane, diethoxyethylmethylketoxime methylsilane, 2-(2-aminoethylthioethyl)diethoxy methylsilane, O,O'-diethyl-S-(2-trimethylsilylethyl)dithiophosphate O,O'-diethyl-S-(2-trimethoxysilylethyl)dithiophosphate, t-butylphenyl dichlorosilane, 3-methcryloxy propyl dimethoxymethylsilane, 3-(3-cyanopropylthiopropyl) dimethoxymethylsilane, 3-(2-acetoxyethylthiopropyl) dimethoxymethylsilane, dimethoxymethyl-2-piperidinoethylsilane, dimethoxymethyl-3-piperazino propylsilane, dibutoxydimethylsilane, dimethoxy-3-(2-ethoxyethylthiopropyl)methylsilane, 3-dimethylaminopropyl diethoxymethylsilane, diethyl-2-trimethylsilyl methylthioethylphosphite, diethoxymethylphenylsilane, decylmethyl dichlorosilane, bis(ethylmethylketoxime)ethoxymethylsilane, diethoxy-3-glycidoxypropyl methylsilane, 3-(3-acetoxypropylthio) propyldimethoxymethylsilane, dimethoxymethyl-3-piperidinopropylsilane, dipropoxy ethylmethylketoxime methylsilane, diphenyl dichlorosilane, diphenyl difluorosilane, diphenylsilane diol, dihexyl dichlorosilane, bis(ethylmethylketoxime)methylpropoxy silane, dimethoxymethyl-3-(4-methylpiperidinopropyl)silane, dodecylmethyl dichlorosilane, dimethoxy diphenylsilane, dimethoxyphenyl-2-piperidinoethoxysilane, dimethoxymethyl-3-(3-phenoxypropylthiopropyl)silane, diacetoxydiphenylsilane, diethoxydiphenylsilane, diethoxydodecyl methylsilane, methyloctadecyl dichlorosilane, diphenylmethoxy-2-piperidino ethoxysilane, docosylmethyl dichlorosilane and diethoxymethyl octadecylsilane.

When the organosilicon compound is employed as starting material of siloxane resin having cross-link structure, polymerization reaction of organosilicon compound is inhibited when n is 3 of the number of bonding hydrolyzability radical (4-n) to silicon atom in general. When n is 0, 1 or 2, in particular n is 0 or 1, the polymerization reaction progresses easily. Storability of coating composition, hardness of coat and so on can be controlled by selecting the starting material.

In other definition, the charge transportable structural unit is a chemical structural unit or a residue of charge transportable compound by which an electric current caused by charge transportation can be detected by a known method for detecting the charge transportation ability such as Time-Of-Flight method.

The charge transferable compound which can form a structural unit having the charge transporting ability in the polysiloxane resin through reaction with an organic silicon compound is described.

The charge transportable compounds include those having a hydroxyl group, a mercapto group, and an amine group.

The charge transportable compounds having a hydroxyl group are represented by formula (3).

$$X—(R_7—OH)_m \quad (3)$$

wherein

X: structural unit providing charge transportability $R_7$: single bonding group, each of a substituted or an unsubstituted alkylene or arylene group m: an integer of from 1 to 5

Of these, listed as representative compounds are such as those described below. Further, for example, triethanolamine based compounds as described herein are those containing a charge transportable triarylamine structure X such as triphenylamine and the like, as well as having a hydroxyl group which bonds to a carbon atom via the carbon atom constituting X group or a hydroxyl group which bonds to a carbon atom via an alkylene or arylene group extended from X.

Next, a synthesis example of the charge transportable compound containing a hydroxy group will be described.

Synthesis of Exemplified Compound B-1

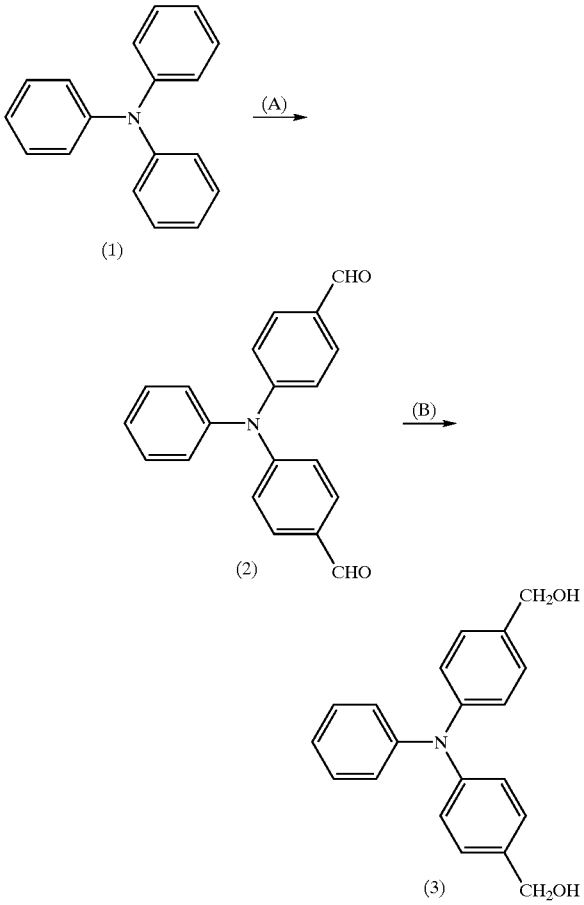

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the reaction solution, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were deposited while stirring. The deposited crystals were collected with filtration, well washed, and dried to obtain Compound (3). The yield was 30 g.

The charge transportable compounds having a mercapto group are represented by formula (4).

$$X—(R_8—SH)_m \quad (4)$$

wherein

X: charge transportability providing group containing alkoxy group bonding to a carbon atom $R_8$: single bonding group, each of a substituted or an unsubstituted alkylene group or an arylene group m: integer of from 1 to 5

The charge transportable compounds having an amino group are represented by formula (5).

$$X—(R_9—NR_{10}H)_m \quad (5)$$

wherein

X: charge transportability providing group containing alkoxy group bonding to a carbon atom $R_9$: single bonding group, each of a substituted or an unsubstituted alkylene group or an arylene group $R_{10}$: hydrogen atom, a substituted or unsubstituted alkyl group, a substituted or an unsubstituted aryl group m: an integer of from 1 to 5

Of charge transportable compounds having an amino group, in the case of primary amine compounds ($-NH_2$), two hydrogen atoms may react with the organic silicon compound, and bonding to the siloxane structure may take place. In the case of secondary amine compounds ($—NHR_{10}$), one hydrogen atom may react with the organic silicon compound, and the remaining Rlo may be any of a remaining group as a branch, a group resulting in a crosslinking reaction, or a compound group having charge transportability.

Further, transportable compounds having a group containing silicon atom are represented by formula (6).

$$X—(—Y—Si(R_{11})_{3-a}(R_{12})_a))n \quad (6)$$

wherein

X: a group containing structural unit providing charge transportability, $R_{11}$: hydrogen atom, a substituted or unsubstituted alkyl group, a substituted or an unsubstituted aryl group, $R_{12}$: hydrolysable group or a hydroxy group, Y: a substituted or unsubstituted alkylene group, a substituted or an unsubstituted arylene group, a: an integer of from 1 to 3, and n: an integer.

Representative compounds represented by formulas (3) to (6) are illustrated below.

(B-1)
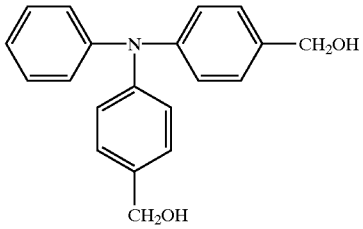
(B-2)
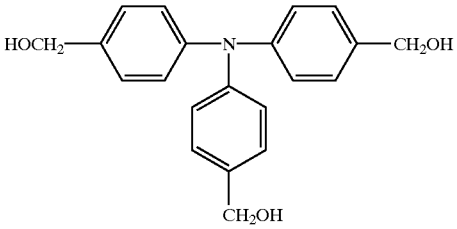
(B-3)
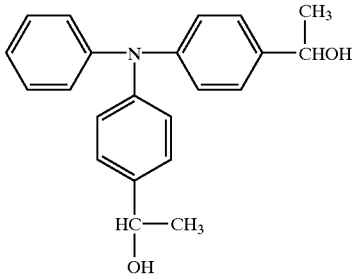
(B-4)
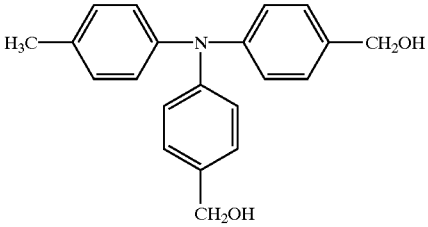
(B-5)
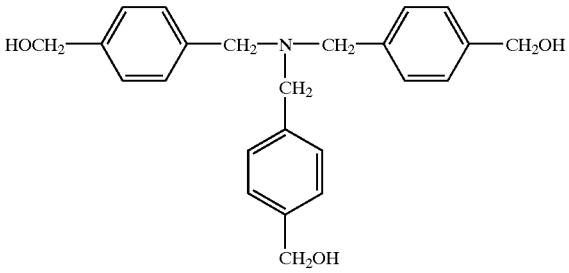
(B-6)
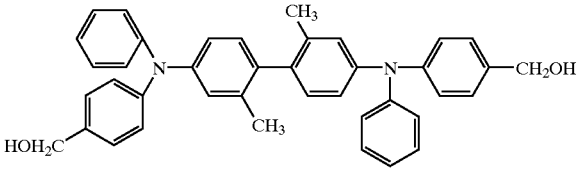
-continued
(B-7)
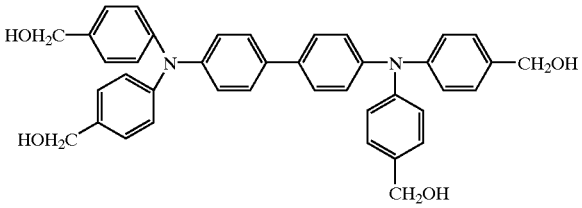
(B-8)
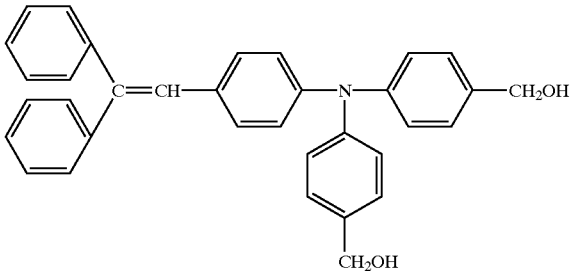
(B-9)
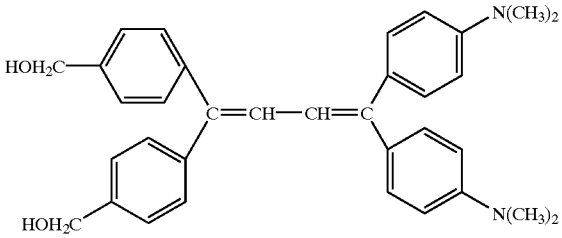
(B-10)
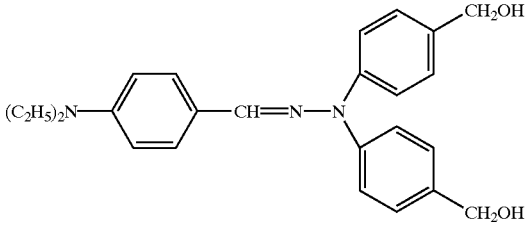
(B-11)
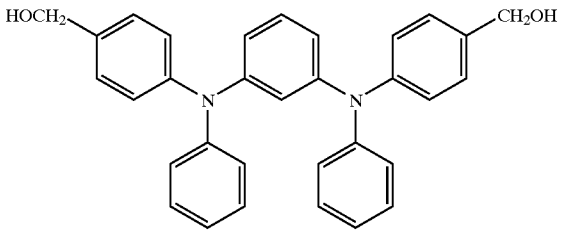

-continued (B-12)

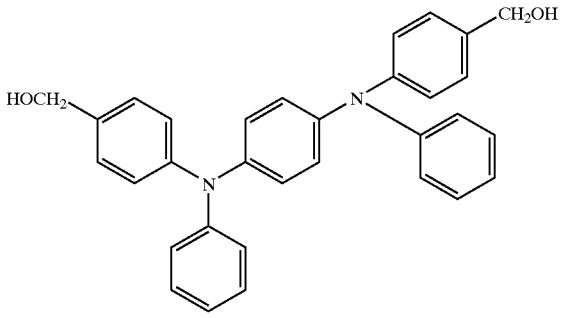

(B-13)

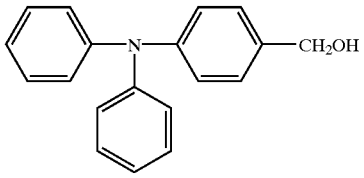

(B-14)

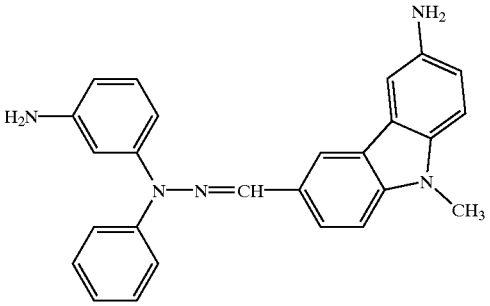

(B-15)

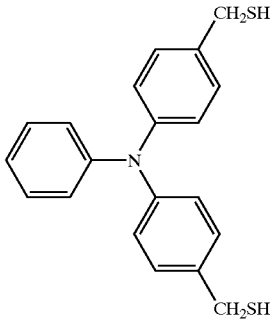

Si-1

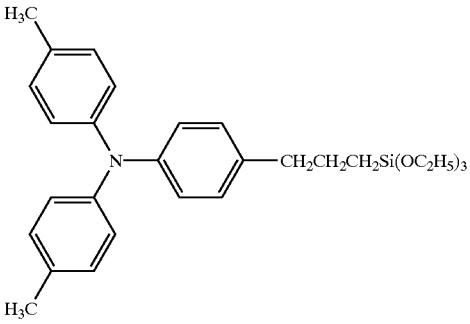

-continued

Si-2

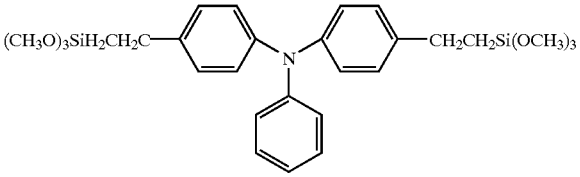

Si-3

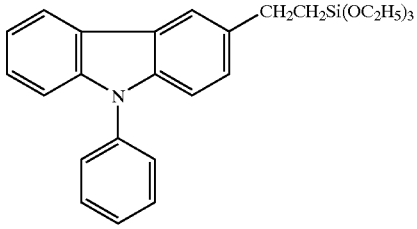

The preferable example of the charge transportable compound is a compound which can form a charge transportable structural unit by a reaction with organic silicon compound in the siloxane resin is described.

The charge transporting structure component in the resin is chemical structural component corresponding to the charge transporting structure component X in the formulas (3) to (6). Examples of hole transporting type CTM which each are contained in the resin as the partial structure thereof are as follows: oxazole, oxadiazole, thiazole, triazole, imidazole, imidazolone, imidazoline, bis-imidazolidine, styryl, hydrazone, benzidine, pyrazoline, stilbene compounds, amine, oxazolone, benzothiazole, benzimidazole, quinazoline, benzofuran, acridine, phenazine, aminostilbene, poly-N-vinylcarbazole, poly-1-vinylpyrene and poly-9-vinylanthrathene.

Examples of electron transporting type CTM which each are contained in the resin as the partial structure thereof are as follows: succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechloroimide, chloranil, bromanil, benzoquinone, naphthoquinone, diphenoquinone, tropoquinone, anthraquinone, 1-chloro-anthraquinone, dinitroanthraquinone, 4-nitrobenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorene, 2,4,7-trinitrofluorenone, 2,4,5,7-tetranitrofluorenone, 9-fluorenylidenedicyanomethylenemalono-nitrile, polynitro-9-fluorenylidenedicyanomethylenemalono-dinitrile, picric acid, o-nitrobenzoic acid, p-nitrobenzoic acid, 3,5-dinitrobenzoic acid, pentafluorobenzoic acid, 5-nitrosalicylic acid, 3,5-dinitroalicylic acid, phthalic acid and mellitic acid.

Molecular weight of a reactive electric charge transportable compound used in the present invention is less than 700, and more than 100 are preferable. Resin layer in which rising of residual potential is small and electrophotography characteristic is good, and excellent in cleaning characteristics can be formed 1 by employing reactive charge transportable compound having molecular weigh of not more than 700. Furthermore, reactive charge transportable compound having molecular weight of not more than 450 and not less than 100 is preferable.

Though the charge transportable group X is denoted as monovalent group, X may contact as bivalent cross-linking group or pendant group simply in the resin when the reactive charge transportable compound to react with the organic silicon compound or condensed siloxane component has two or more reactive functional group.

The resin layer according to the invention contains the resin having the thermoplastic organic polymer component, the condensed siloxane component and the charge transportable component. In the resin layer, these resins are chemically bonded with each other and the whole of the resin layer is constituted by the resin having a cross-linked structure.

The weight ratio of the charge transportable component to the sum of the thermoplastic organic polymer component and the condensed siloxane component in the resin is preferably from 1:0.01 to 1:20, more preferably from 1:0.01 to 1:10. When the weight ratio of the charge transportable component is less, the strength of the resin layer is lowered and when the ratio is excess, the electrophotographic characteristics such as charging capacity, sensitivity and residual potential at the repeated use, is deteriorated and the physical strength of the resin layer is also lowered.

The weight ratio of the condensed siloxane component and the charge transportable component to the thermoplastic organic polymer component in the resin is preferably from 0.25 to 4 and from 0.02 to 50, respectively with reference to 1 of the thermoplastic organic polymer component. When the weight ratio of the siloxane condensate component is less, the strength of the resin layer is lowered and when the ratio is excess, the cleaning suitability is deteriorated and the adhesiveness of the resin layer with the photosensitive lower layer is also lowered. When the weight ratio of the charge transportable component is less, the strength of the resin layer is lowered and when the ratio is excess, the electrophotographic characteristics such as charging capacity, sensitivity and residual potential at the repeated use, is deteriorated and the physical strength of the resin layer is also lowered.

When the resin layer is applied to the outermost layer, thickness of the layer is preferably 0.03 to 10 $\mu$m, and more preferably 0.1 to 5 $\mu$m, which is thicker than conventional photoreceptor. According to the present invention, anti-abrasion characteristics, toner cleaning characteristics, stability against curling of cleaning blade can be improved without deterioration of electrostatic characteristic such as sensitivity or residual potential though the thickness is thicker than that of conventional outermost layer. Further, clear image can be obtained in the high moisture circumstances.

In either producing methods, it is preferred that the ratio of the silane compound, the vinyl resin having the siloxane condensate and the silyl group and reactive charge transportable compound in the coating composition may be a ratio so that the ratio of the organic polymer component, the siloxane condensate component and the charge transportable component in the obtained resin layer is within the foregoing range. For example, the weight ratio of the silane compound, the silyl group-containing vinyl resin and the reactive charge transportable compound is preferably 100:25 to 400:1 to 1000.

Moreover, the weight ratio of the silane compound having the epoxy group or the open ring epoxy group and the other silane compound is preferably 1:0.01 to 100, more preferably 1:1 to 20.

Metal oxide particles may be compounded in the resin layer whereby anti-abrasion characteristics, toner cleaning characteristics, and stability against curling of cleaning blade are further improved.

Primary diameter of the metal oxide particles is preferably from 5 to 500 nm. The metal oxide particles can be obtained as colloidal particles, usually synthesized by liquid phase method. Example of the metal atom of the metal oxide includes Si, Ti, Al, Cr, Zr, Sn, Fe, Mg, Mn, Ni, and Cu.

The metal oxide particles preferably have a compound group which can react with the organic silicon compound at the surface of the particles. Examples of the compound group which can react with the organic silicon compound include hydroxy and amino group. The compound group which can react with the organic silicon compound forms a resin layer in which the condensed siloxane composition of the resin reacts with the surface of the metal oxide particles complicatedly, and forms a resin layer hard to wear against the blade abrasion and having excellent electrostatic characteristics. Content is preferably from 0.1 to 30 weight % with reference to the whole resin layer. Deterioration of image can be occurred in excess amount.

The resin layer may incorporate organic fine particles. The organic fine particles reduce the surface energy of the resin layer and improve the cleaning characteristics. Example of the organic fine particle includes fluorine resin, silicon resin, acryl resin and olefin resin. Particularly preferable example is fluorine resin such as polytetrafluoroethylene or polyfluorovinylidene, olefin resin such as polyethylene and polyolefin. The organic fine particles can be employed in single kind or plural kinds in combination.

The organic fine particles have average volume particle size or maximum length of projected particles of from 0.01 to 1.0 $\mu$m, preferably from 0.01 to 0.3 $\mu$m. The organic fine particles are incorporated at a content of from 0.1 to 30 weight % of the whole weight of the resin layer. The excess amount may deteriorate the sensitivity of the photoreceptor or induce fogging due to elevating residual potential of the photoreceptor in repeated use.

Anti-oxidant having partial structure such as hindered phenol, hindered amine, thioether or phosphite can be incorporated in the resin layer. It is effective in stabilizing voltage at the change of circumstances or improving image quality.

The hindered phenols as described herein means compounds having a branched alkyl group in the ortho position relative to the hydroxyl group of a phenol compound and derivatives thereof. (The hydroxyl group may be modified to an alkoxy group.)

Further, listed as hindered amines are compounds having an organic group represented by the following structural formula:

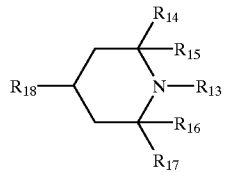

wherein $R_{21}$ represents a hydrogen atom or a univalent organic group, $R_{22}$, $R_{23}$, $R_{24}$, and $R_{25}$ each represents an alkyl group, and $R_{26}$ represents a hydrogen atom, a hydroxyl group, or a univalent organic group.

Listed as antioxidants having a partial hindered phenol structure are compounds described in JP O.P.I. No. 1-118137 (on pages 7 to 14).

Listed as antioxidants having a partial hindered amine structure are compounds described in JP O.P.I. No. 1-118138 (on pages 7 to 9).

Examples of antioxidant are illustrated below.

1-1
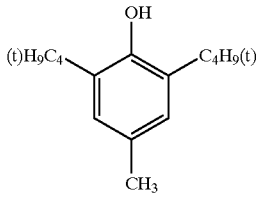
1-2
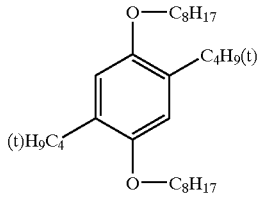
1-3
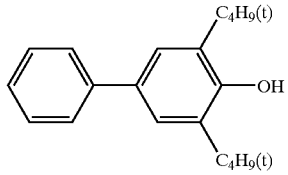
1-4
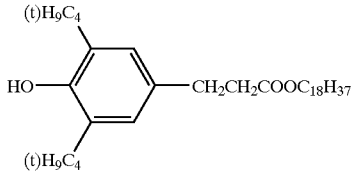
1-5
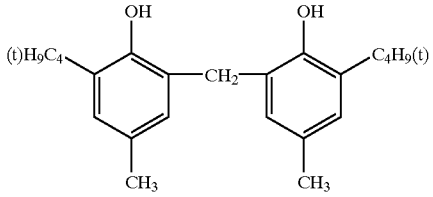
1-6
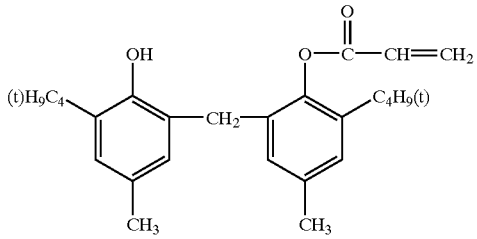
1-7
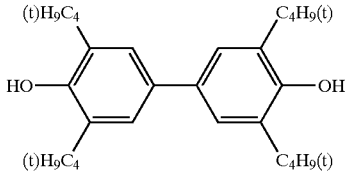
1-8
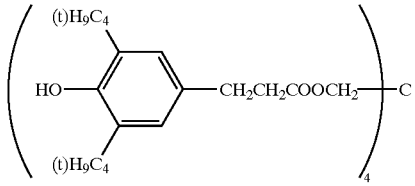
1-9
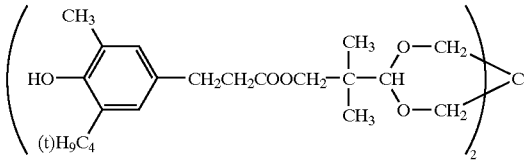
1-10
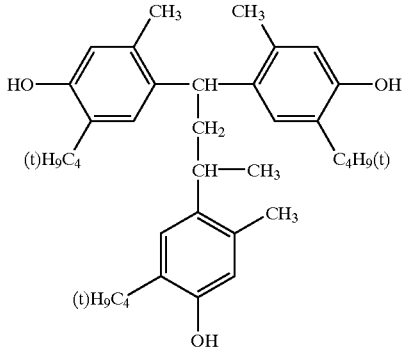
2-1
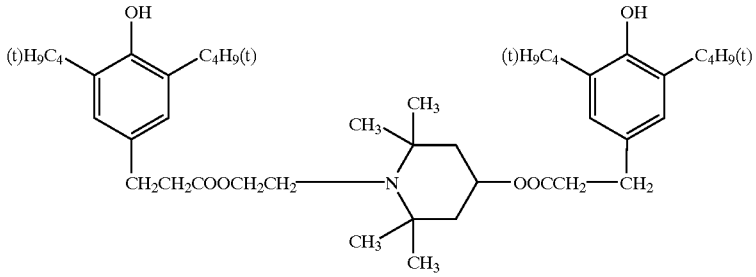

-continued 2-2

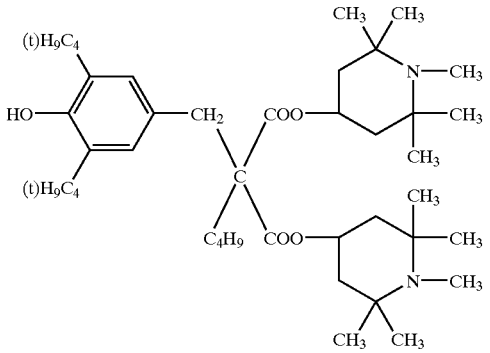

2-3

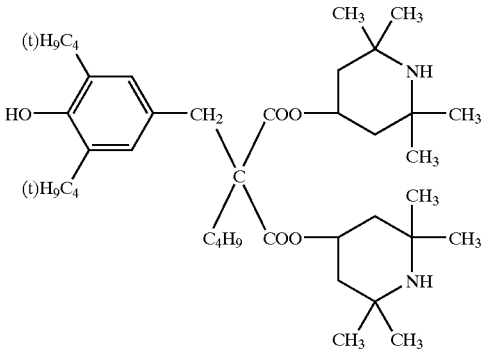

2-4

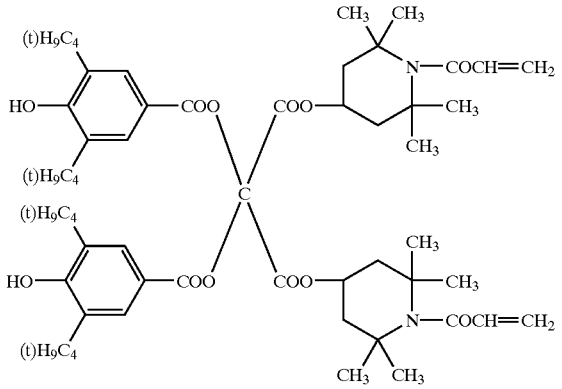

2-5

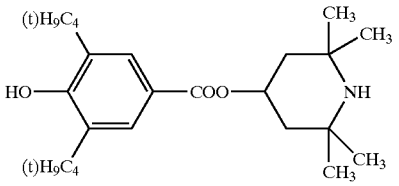

2-6

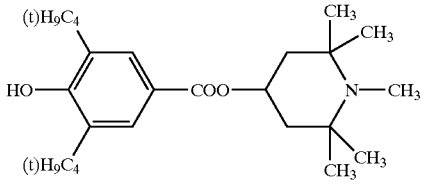

2-7

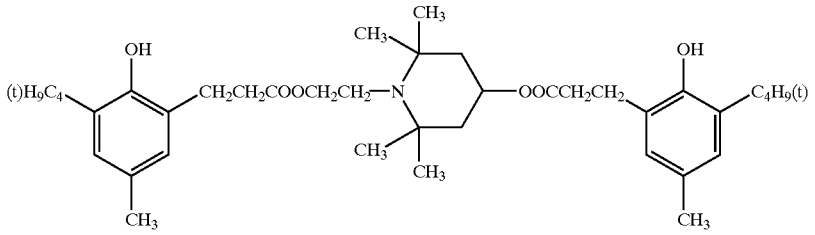

Hindered phenol type antioxidant: Ilganox 1076, Ilganox 1010, Ilganox 1098, Ilganox 245, Ilganox 1330, Ilganox 3114, Ilganox 1076, and 3,5-di-t-butyl-4-hydroxybiphenyl.

Hindered amine type antioxidant: Sanol LS2626, Sanol LS765, Sanol LS770, Sanol LS744, Tinuvin 144, Tinuvin 622LD, Mark LA57, Mark LA67, Mark LA62, Mark LA68 and Mark LA63.

Thioether type antioxidant: Sumirizer TPS and Sumirizer TP-D.

Phosophite type antioxidant: Mark 2112, Mark PEP-8, Mark PEP-24G, Mark PEP-36, Mark 329K and Mark HP-10.

The hindered phenol and hindered amine anti-oxidants are preferably employed among these. The anti-oxidant is used in an amount of from 0.1 to 10 weight % with reference to the amount of solid component of the resin layer.

The representative preparation method of the resin layer is described.

The resin layer can be formed by coating and hardening thereafter a coating liquid containing the organic polymer having the silyl group in the side chain thereof, and the reactive charge transportable compound, preferably on the photosensitive layer.

The resin layer can also be formed by coating and hardening a coating liquid containing the organic polymer having the siloxane condensate in the side chain which is formed by using the silane compound and the reactive charge transportable compound.

The organic polymer may contain anti-oxidant component, a component having fluorine atom, or epoxy group.

In concrete, the resin layer may be either formed by coating and hardening a coating liquid of a mixture of the vinyl resin having silyl group at side chain, the silane compound and the reactive charge transportable compound.

On the other way, preliminary a vinyl resin having siloxane condensate at side chain thereof is prepared by mixing the vinyl resin having silyl group at side chain thereof and the organic silicon compound, then it is mixed with the organic compound and the reactive charge transportable compound to prepare a coating composition, the resulted coating composition is coated and hardened.

The siloxane condensate is made to three-dimensional structure and the siloxane condensate, and the silyl group-containing vinyl resin and the reactive charge transportable compound are chemically bonded through the silyl group or the reactive group by the hardening process. Thus the resin layer is formed which has a high wearing resistively and adhesiveness with the photosensitive layer and a suitable cleaning suitability.

A resin having anti-oxidant may be formed in the following way. The siloxane condensate may formed at a silyl group of the silyl-modified vinyl polymer by using the silyl-modified vinyl polymer having the hindered amine group or the hindered phenol group and the following organic silicon compound. The formation of the siloxane condensate component may be carried out at the period of formation or resin layer or by the procedure that the condensate is previously formed at the terminal of the silyl group in the resin solution and then the resin layer is formed.

In the invention, "having the hindered amine group or the hindered phenol group" means that the resin has at least one of the hindered amine group and the hindered phenol group. The resin may have both of the groups.

In one embodiment of the invention, the resin layer can be formed by coating and hardening thereafter a coating composition containing the organic polymer having the silyl group in the side chain thereof, the silane compound having at least the epoxy group or the open ring epoxy group and the reactive charge transportable compound on the photosensitive layer.

The resin layer can also be formed by coating and hardening a coating composition containing the organic polymer having the siloxane condensate in the side chain which is formed by using the silane compound having the epoxy group or the open ring epoxy group.

The resin layer may be either formed by coating and hardening a coating liquid of a mixture of the vinyl resin having silyl group at side chain, the silane compound having the epoxy group or the open ring epoxy group and the reactive charge transportable compound. On the other way, preliminary a vinyl resin having siloxane condensate at side chain thereof is prepared by mixing the vinyl resin having silyl group at side chain thereof and the silane compound having the epoxy group or the open ring epoxy group, then it is mixed with the organic compound and the reactive charge transportable compound to prepare a coating composition, the resulted coating composition is coated and hardened.

The weight ratio of the silane compound having the epoxy group or the open ring epoxy group and the other silane compound is preferably 1:0.01 to 100, more preferably 1:1 to 20.

In the other embodiment of the invention, the resin layer can be formed by coating and hardening thereafter a coating composition containing the organic polymer having the silyl group and the vinyl component containing fluorine atom, the silane compound and the reactive charge transportable compound, or the resin layer can also be formed by coating and hardening a coating liquid containing the organic polymer having vinyl component containing fluorine atom and the siloxane condensate in the side chain which is formed by using the silane compound and the reactive charge transportable compound.

The resin layer can also be formed by coating and hardening a coating composition containing the organic polymer having the vinyl resin containing fluorine atom and the siloxane condensate in the side chain which is formed by using the silane compound.

The resin layer may be either formed by coating and hardening a coating liquid of a mixture of the vinyl resin containing fluorine atom and having silyl group at side chain, the silane compound and the reactive charge transportable compound. On the other way, preliminary a vinyl resin having siloxane condensate at side chain thereof is prepared by mixing the vinyl resin containing fluorine atom and having silyl group at side chain thereof and the silane compound, then it is mixed with the organic compound and the reactive charge transportable compound to prepare a coating composition, the resulted coating composition is coated and hardened.

In both of the methods, the weight ratios of the organic silicon compound to the vinyl polymer the fluorine-containing vinyl component and the silyl group may be a ratio so that the weight ratio of the vinyl polymer component to the siloxane component is within the foregoing range. For example, the weight ratio of the organic silicon compound to the vinyl polymer having the fluorine-containing vinyl group and the silyl group is preferably 1:0.25 to 4 when the compound represented by Formula 2 is used as the organic silicon compound.

In either producing methods, it is preferred that the ratio of the silane compound, the vinyl resin having the siloxane condensate and the silyl group and reactive charge transportable compound in the coating liquid may be a ratio so that the ratio of the organic polymer component, the siloxane condensate component and the charge transportable component in the obtained resin layer is within the foregoing range. For example, the weight ratio of the silane compound, the silyl group-containing vinyl resin and the reactive charge transportable compound is preferably 100:25 to 400:1 to 1000.

Practically the coating composition may be prepared by mixing a reaction product of the organic silicon compound with the vinyl resin containing silyl group in the market such as Glasca HPC7506 (acryl resin having silyl group in side chain, product by JSR Co., Ltd.) with the organic silicon compound and reactive charge transportable compound in place of reacting the organic silicon compound with the vinyl resin containing silyl group.

It is preferable that a metal chelate compound is added in the coating composition or during preparation of coating composition to promote the reaction of the organic silicon compound, the vinyl resin containing silyl group and the reactive charge transportable compound. Example of the metal chelate compound is a chelate compound of metal selected from a group of zirconium, titanium and aluminum. The chelate compound is referred to "metal chelate compound (III)". The metal chelate compound (III) is considered to work to promote hydrolysis and/or partial condensation reaction of the silicon compound, the vinyl resin containing silyl group and the reactive charge transportable compound, whereby the formation of condensate from three components is promoted.

Examples of the metal chelate compound (III) include the compound represented by formula (7), (8) or (9), or partial hydrolyzed compound thereof.

$$Zr(OR_5)_p(R_6COCHCOR_7)_{4-p} \quad (7)$$

$$Ti(OR_5)_qR_6COCHCOR_7)_{4-q} \quad (8)$$

$$Al(OR_5)_rR_6COCHCOR_7)_{3-r} \quad (9)$$

In the formula of (7), (8) and (9) $R_5$ and $R_6$ each represent hydrocarbon group having 1–6 carbon atoms, such as ethyl, n-propyl, I-propyl, n-butyl, sec-butyl, t-butyl, n-pentyl, n-hexyl, cyclohexyl, and phenyl group. $R_7$ includes the hydrocarbon group represented by $R_5$ and $R_6$ and further alkoxy group having 1–16 carbon atoms, such as methoxy, ethoxy, n-propoxy, I-propoxy, n-butoxy, sec-butoxy, t-butoxy, lauriloxy and steric oxy group. P and q is an integer of from 0 to 3, r is an integer of from 0 to 2.

Concrete example of such a metal chelate compound (III) includes zirconium chelate compound such as tri-n-butoxy ethyl acetoacetate zirconium, di-n-butoxy bis(ethyl acetoacetate)zirconium, n-butoxy tris(ethylacetoacetate) zirconium, tetrakis(n-propyl acetoacetate)zirconium, tetrakis acetylacetoacetate)zirconium, and tetrakis(ethyl acetoacetate)zirconium; titanium chelate compound such as di-i-propoxy bis(ethylacetoacetate)titanium, di-i-propoxy bis(acetylacetate)titanium, di-i-propoxy bis(acetylacetone) titanium; and aluminum chelate compound such as di-i-propoxy ethylacetoacetate aluminum, di-i-propoxy acetylacetonato aluminum, i-propoxy bis(ethylacetoacetate) aluminum, i-propoxy bis(acetylacetonato)aluminum, tris (ethylacetoacetate)aluminum, tris(ethylacetate) aluminum, tris(acetylacetonato)aluminum, and monoacetylacetonato bis(ethylacetoacetate)aluminum. The metal chelate compound can be used singly or plurally in combination.

Content of the metal chelate compound (III) in the whole amount of solid content of the coating composition composed of the organic silicon compound, siloxane condensate, the vinyl resin containing silyl group, and the reactive charge transportable compound is from 0.01 to 20 weight 1, preferably from 0.5 to 20 weight %. When the content is less reaction forming three dimension structure in the resin layer may be insufficient, and when it is excess pot life deteriorates.

The coated composition is cured by drying preferably at from 60 to 150° C. for from 30 minutes to 6 hours depending on the reaction ability of the organic silicon compound employed.

It is preferable to employ organic solvent for promoting the hardening reaction. Suitable example of available organic solvent includes alcohols, aromatic hydrocarbons, ether compound, ketones, and esters. Amount of the organic solvent to be used is not restricted with reference to amount of the organic silicon compound but adjusted for the purpose.

Solvent which dissolve the organic silicon compound, the vinyl resin containing silyl group, and reactive charge transportable compound uniformly is preferably used for the solvent to promote the hardening reaction. Example of the solvent includes alcohols, aromatic hydrocarbons, ether compound, ketones, and esters. Particularly preferable examples are listed below.

Alcohols such as alcohol having from 1 to 4 carbon atoms, that is, methanol, ethanol, n-propanol, iso-propanol, n-butanol, iso-butanol, sec-butanol and tert-butanol are preferable.

Ketones such as ethyl methyl ketone, methylisopropyl ketone, and methylisobutyl ketone is employed as non-alcohol solvent.

Hardening promoting agent can be added to the coating composition for the resin layer if necessary.

Example of the promoter includes, alkali metal salt of acid such as naphthenic acid, octyl acid, nitrous acid, sulfurous acid, Armin acid, and carbonic acid; acid compound such as alkyl titanic acid, phosphoric acid, p-toluenesulfonic acid, phthalic acid; amine compound such as ethylenediamine, hexanediamine, diethylenetriamine, triethylenetetramine, tetraethylenepentamine, piperidine, piperazine, metaphenylenediamine, ethanolamine, triethylamine, various types of degeneration amine employed as hardener of epoxide resin, γ-aminopropyl triethoxysilane, γ-(2-aminoethyl)-aminopropyltrimethoxysilane, γ-(2-aminoethyl)-aminopropylmethyl dimethoxysilane, γ-anilino propyltrimethoxysilane; carboxylic acid organic stannous compound such as $(C_4H_9)_2Sn(OCOC_{11}H_{23})_2$, $(C_4H_9)_2Sn(OCOCH{=}CHCOOCH_3)_2$, $(C_4H_9)_2Sn(OCOCH{=}CHC_4H_9)_2$, $(C_8H_{17})_2Sn(OCOC_{11}H_{23})_2$, $(C_8H_{17})_2$ $Sn(OCOCH{=}CHCOOCH_3)_2$, $(C_8H_{17})_2Sn(OCOCH{=}CHCOOC_4H_9)_2$ and $(C_8H_{17})_2Sn(OCOCH{=}CHCOOC_8H_{17})_2$; mercaptides organic stannous compound such as $(C_4H_9)_2Sn$ $(SCH_2COO)_2$, $(C_4H_9)_2Sn(SCH_2COOC_8H_{17})_2$, $(C_8H_{17})_2Sn(SCH_2COO)_2$, $(C_8H_{17})_2Sn(SCH_2CH_2COO)_2$, $(C_8H_{17})_2Sn(SCH_2COOCH_2CH_2OCOCH_2S)_2$, $(C_8H_{17})_2Sn(SCH_2COOC_8H_{17})_2$, $(C_8H_{17})_2Sn(SCH_2COOC_{12}H_{25})_2$, and

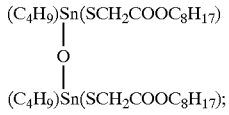

sulfide organic stannous compound such as

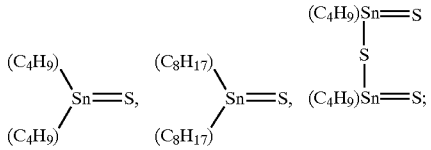

and tin compound such as reaction product of organic tin oxide such as $(C_4H_9)_2SnO$ and $(C_8H_{17})_2SnO$ with ester compound such as ethylsilicate, ethylsilicate 40, dimethylmaleate, diethylmaleate and dioctylphthalate.

Content of the hardening promoter in the coating composition is from 0.1 to 20, preferably 0.5 to 100 weight parts with reference to 100 parts of solid content of coating composition (amount of residual component after drying). When the amount is insufficient layer strength may deteriorated and when the amount is excess pot life of the coating composition deteriorated.

The resin layer may be prepared by incorporating the metal oxide particles, organic fine particles and anti-oxidant as required in to the coating composition.

Organic solvent may be employed for adjusting the solid content as well as viscosity of the resin layer. Example of the solvent includes organic solvent such as alcohols, aromatic hydrocarbons, ether compound, ketones, and esters. The alcohols include mono-valent or divalent alcohols such as methanol, ethanol, n-propyl alcohol, isopropanol, n-butyl alcohol, sec-butyl alcohol, t-butyl alcohol, n-hexyl alcohol, n-octyl alcohol, ethylene glycol, diethylene glycol, triethylene glycol, ethylene glycol monomethyl ether, ethylene glycol monoethyl ether, ethylene glycol mono n-propyl ether, ethylene glycol mono n-butyl ether, acetic acid ethylene glycol monomethyl ether and acetic acid ethylene glycol monoethyl ether. Saturated aliphatic alcohol having from 1 to 8 carbon atoms is preferably employed. Concrete example of the aromatic hydrocarbons includes benzene, toluene and xylene. Concrete example of the esters is listed as ethylacetate, n-propylacetate, n-butylacetate, and propylenecarbonate. The organic solvent may be used singly or pluraly in combination. Method for addition of the organic solvent is not particularly restricted and added during the preparation of the coating composition and/or at any step after preparation.

The resin layer can be applied to a photoreceptor having any photosensitive material such as inorganic or organic photosensitive material, and preferably it is applied to an organic photosensitive material. The organic photosensitive material comprises at least one of charge generating function and charge transporting function, which include a photosensitive material composed of organic charge generating material or organic charge transporting material, or a photosensitive material composed of polymer chelate having charge generating function and organic charge transporting function.

The organic photoreceptor has preferably photosensitive layer such as charge generation layer and charge transporting layer or single layer having charge generation/charge transporting function and a resin layer provided on the photosensitive layer.

Electrically Conductive Support

Employed as electrically conductive supports may be those which are either in sheet or in cylindrical form. However, in order to make an image forming apparatuses small-sized, an electrically conductive cylindrical support is more preferred.

The electrically conductive cylindrical support as described in the present invention means a cylindrical support which is capable of endlessly forming images through its rotation, and the electrically conductive support is preferred which has a circularity of not more than 0.1 mm and a deviation of not more than 0.1 mm. When said circularity as well said deviation exceeds said limits, it becomes difficult to form consistently excellent images.

Employed as electrically conductive materials may be metal drums comprised of aluminum, nickel, and the like, plastic drums vacuum coated with aluminum, tin oxide, indium oxide, and the like, or paper-plastic drums coated with these kinds of electrically conductive materials. Said electrically conductive supports preferably exhibit a specific resistance of $10^3$ Ωcm or more.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is usually 20 μm or less, particularly 10 μm or less is preferable in average.

In the present invention, an interlayer, functioning as a barrier, may be provided between the electrically conductive support and the photosensitive layer.

In order to improve adhesion between the electrically conductive support and said photosensitive layer or to minimize charge injection from said support, provided is the sublayer employed on the photoreceptor of the present invention between said support and said photosensitive layer. Listed as materials of said sublayer are polyamide resins, vinyl chloride resins, vinyl acetate resins, and copolymer resins comprising at least two repeating units of these resins. Of these subbing resins, polyamide resins are preferable as the resins which are capable after repeated use of minimizing an increase in residual potential. Further, the thickness of the interlayer comprised of these resins is preferably between 0.01 and 0.5 μm.

Listed as the sublayer, which is most preferably employed, is those comprised of hardenable metal resin which is subjected to thermal hardening employing organic metal compound such as silane coupling agent, titanium coupling agent, and the like. The thickness of the interlayer comprised of said hardenable metal resins is preferably between 0.1 and 2 μm.

Photosensitive Layer

The photosensitive layer configuration of the photoreceptor of the present invention may be one comprising a single layer structure on said interlayer, which exhibits a charge generating function as well as a charge transport function. However, a more preferable configuration is that the photosensitive layer is comprised of a charge generating layer (CGL) and a charge transport layer (CTL). By employing said configuration of distinct functions separated, it is possible to control an increase in residual potential, under repeated use at a low level, and to readily control the other electrophotographic properties to desired values. A negatively chargeable photoreceptor is preferably composed in such a manner that applied onto the interlayer is the charge generating layer (CGL), onto which the charge transport layer is applied. On the other hand, a positively chargeable photoreceptor is composed so that the order of the layers employed in the negatively chargeable photoreceptor is reversed. The most preferable photosensitive layer configuration is the negatively chargeable photoreceptor configuration having said distinct functional structure.

The photosensitive layer configuration of the negatively chargeable photoreceptor having a distinct function separated will now be described.

Charge Generating Layer

The charge generating layer comprises charge generating materials (CGM). As to other materials, if desired, binder resins and other additives may be incorporated.

Employed as charge generating materials may be those commonly known in the art. For example, employed may be phthalocyanine pigments, azo pigments, perylene pigments, azulenium pigments, and the like. Of these, CGMs, which are capable of minimizing an increase in residual potential under repeated use, are those which comprise a three-dimensional electrical potential structure capable of forming stable agglomerated structure among a plurality of molecules. Specifically listed are CGMs of phthalocyanine pigments and perylene pigments having a specific crystalline structure. For instance, titanyl phthalocyanine having a maximum peak at 27.2° of Bragg angle 2θ with respect to a Cu—Kα line, benzimidazole perylene having a maximum peak at 12.4° of said Bragg 2θ, and the like, result in minimum degradation after repeated use, and can minimize the increase in residual potential.

When in the charge generating layer, binders are employed as the dispersion media of CGM, employed as binders may be any of the resins known in the art. Listed as the most preferable resins are formal resins, butyral resins, silicon resins, silicon modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As other materials, if desired, incorporated may be additives such as antioxidants and the like.

Employed as charge transfer materials (CTM) may be any of those known in the art. For example, it is possible to employ triphenylamine derivatives, hydrazone compounds, styryl compounds, benzidine compounds, butadiene compounds, and the like. These charge transport materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.25 eV, from a combined CGM.

The ionization potential of CGM and CTM is measured employing a Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicon resins, melamine resins, and copolymers comprising at least two repeating units of these resins, and other than these insulating resins, high molecular organic semiconductors such as poly-N-vinylcarbazole.

Polycarbonate resins are most preferable as CTL binders. Polycarbonate resins are most preferred because of improved dispersibility of CTM as well as electrophotographic properties. The ratio of binder resins to charge transport materials is preferably between 10 and 200 weight parts per 100 weight parts of the binder resins. Further, the thickness of the charge transport layer is preferably between 10 and 40 $\mu$m.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like, however the present invention is not limited these. Of these, most preferably employed are dichloromethane, 1,2-dichloroethane or methyl ethyl ketone. Furthermore, these solvents may be employed individually or in combination of two types or more.

Next, employed as coating methods to produce the electrophotographic photoreceptor of the present invention may be a dip coating method, a spray coating method, a circular amount regulating type coating method, and the like. In order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. The above-mentioned circular amount control type coating is detailed in, for example, Japanese Patent Publication Open to Public Inspection No. 58-189061.

FIG. 1 is a cross-sectional view of an electrophotographic image forming apparatus as one example of the image forming apparatus of the invention. In FIG. 1, reference numeral 50 is a photoreceptor drum (a photoreceptor) which is an image bearing body. Said photoreceptor is prepared by applying an organic photosensitive layer onto the drum, and further by applying the resinous layer of the present invention onto the resultant layer. It is grounded and rotated clockwise. Reference numeral 52 is a scorotron charging unit which uniformly charges the circumferential surface of photoreceptor drum 50 via corona discharge. Prior to charging, employing said charging unit 52, in order to eliminate the hysteresis of said photoreceptor due to the previous image formation, the photoreceptor surface may be subjected to charge elimination through exposure, employing exposure section 51 comprised of light emitting diodes and the like.

After uniformly charging the photoreceptor, image exposure is carried our based on image signals employing image exposing unit 53. Said image exposing unit comprises a laser diode, not shown, as the exposure light source. Scanning onto the photoreceptor drum is carried out employing light of which light path has been deflected by reflection mirror 532 through rotating polygonal mirror 531, fθ lens, and the like, and thus an electrostatic latent image is formed.

The surface of the photoreceptor is uniformly charged by charging unit 52, and exposed imagewise and developed. The image exposed portion is developed and the non-image exposed portion is not developed since developing bias potential is applied to the photoreceptor by developing sleeve 541, in the reversal developing process.

The resultant electrostatic latent image is subsequently developed, employing development unit 54. Around photoreceptor drum 50, development unit 54, which stores the developer material comprised of a carrier and a toner, is provided, and development is carried out employing development sleeve 541, internally comprised of magnets and rotates while bearing the developer material. The interior of said developer unit 54 is fabricated with developer material stirring member 544, developer material conveying member 543, conveying amount regulating member 542, and the like. Thus, the developer material is stirred, conveyed and supplied to said development sleeve. The supply amount is controlled by said conveying amount regulating member 542. The conveyed amount of said developer material varies depending on the linear speed of an applied organic electrophotographic photoreceptor as well as its specific gravity, but is commonly in the range of 20 to 200 mg/cm$^2$.

Said developer material is comprised of, for example, a carrier which is prepared by coating insulation resins onto the surface of the aforementioned ferrite as the core, and a toner which is prepared by externally adding silica, titanium oxide, and the like, to colored particles comprised of the aforementioned styrene-acryl based resins as the primary material, colorants such as carbon black, and the like, charge control agents, and low molecular weight polyolefin of the present invention. Said developer material is regulated employing said conveying amount regulating member, and then conveyed to the development zone, where development is then carried out. At that time, development is carried out while direct current bias voltage, if desired, alternative current bias voltage is applied to the space between photoreceptor drum 50 and development sleeve 541. Further, the developer material is subjected to development in a contact or non-contact state with the photoreceptor.

Recording paper P is supplied to the transfer zone by the rotation of paper feeding roller 57, when timing for transfer is properly adjusted.

In the transfer zone, transfer roller (in the transfer unit) 58 is brought into pressure contact with the circumferential surface of photoreceptor drum 50, while synchronizing with transfer timing, and image transfer is carried out onto fed recording paper P which is brought into contact with both said photoreceptor drum 50 and said transfer roller 58.

Subsequently, the resultant recording paper P is subjected to charge elimination, employing separation brush 59 (in the separation unit) 59 which is brought into pressure contact at almost the same time as when said transfer roller is brought into the same state, is separated from the circumferential surface of photoreceptor drum 50, and conveyed to fixing unit 60. Then, after the toner is fused under heat and pressure, provided by heated roller 601 as well as pressure contact roller 602, the resulting recording paper P is ejected to the exterior of the apparatus via paper ejection roller 61. Further, after passage of recording paper P, said transfer roller 58, as well as said separation brush, withdraws from the circumferential surface of photoreceptor drum 50, and is prepared for the formation of subsequent toner images.

On the other hand, photoreceptor drum 50, from which recording paper P has been separated, is subjected to removal of any residual toner and cleaning through pressure contact with blade 621 of cleaning unit 62, and then subjected to charge elimination employing precharge exposure section 51, as well as subjected to charging employing charging unit 52. Said photoreceptor drum 50 then enters the subsequent image forming process.

Reference numeral 70 is a detachable processing cartridge, which is integrally comprised of a photoreceptor, a charging unit, a transfer unit, a separation unit, and a cleaning unit.

The electrophotographic photoreceptor of the present invention can generally be applied to electrophotographic apparatuses such as copiers, laser printers, LED printers, liquid crystal shutter type printers, and the like, and can further be widely applied to apparatuses such as displays, recording media, small volume printing, plate making, facsimile production, and the like, to which common electrophotographic techniques are applied.

EXAMPLE

The invention is described below according to examples. In the followings, "parts" means "parts by weight".

Example 1

Preparation of Photoreceptor 1

Photoreceptor 1 was prepared as follows.

| <Subbing layer> | |
|---|---|
| Titanium chelate compound TC-750 (Matsumoto Seiyaku Co., Ltd.) | 30 g |
| Silane coupling agent KBM-503 (Shin'etsu Kagaku Co., Ltd.) | 17 g |
| 2-propanol | 150 ml |

The above coating liquid was coated on an electroconductive sylindrical substrate having a diameter of 100 mm so that the layer thickness is 0.5 $\mu$m.

| <Charge generation layer> | |
|---|---|
| Y-type titanylphthalocyanine having the maximum peak of Bragg angle 2θ(±0.2) at 27.7° in Cu-α X-ray diffraction spectrum | 60 g |
| 2-butanone | 2000 ml |

The above-mentioned were mixed and dispersed for 10 hours by a sandmill to prepare a charge generation layer coating liquid. The coating liquid was coated on the foregoing subbing layer by an immersion coating method so as to form a charge generation layer with a thickness of 0.2 $\mu$m.

| <Charge transportation layer> | |
|---|---|
| Charge transportable substance, N-(4-methylphenyl)-N-{4-(β-phenylstylyl)phenyl}-p-toluidine | 225 g |
| Polycarbonate (Viscosity average molecular weight: 30,000) | 300 g |
| Antioxidant (Exemplified compound 1-3) | 6 g |
| Dichloromethane | 2000 ml |

The above-mentioned were dissolved to prepare a charge transportation layer coating liquid. The coating liquid was coated on the charge generation layer by an immersion coating method so as to form a charge transportation layer with a thickness of 20 $\mu$m.

| <Surface layer> | |
|---|---|
| Siloxane-containing acryl resin HPC7506 (JRS Co., Ltd.) | 150 g |
| Reactive charge transportable compound (Exemplified compound B-1) | 6 g |
| Antioxidant (Exemplified compound 2-1) | 0.3 g |
| 2-propanol | 115 g |
| Hardening agent HPC404 (JSR co., Ltd.) | 15 g |

The above-mentioned were mixed to prepare a coating solution of the resin layer. The coating liquid was coated on the foregoing charge transportation layer by a disk quantity regulation coating apparatus so as to form a resin layer with a thickness of 2 $\mu$m. The coated layer was thermally hardened by heating for 1 hour at 120° C. Thus Photoreceptor 1 was prepared.

Preparation of Photoreceptor 2

Photoreceptor 2 was prepared in the same manner as in photoreceptor 1 except that the reactive charge transportable substance Exemplified compound B-1 was replaced by Exemplified compound Si-1.

Preparation of Photoreceptor 3

Photoreceptor 3 was prepared in the same manner as in photoreceptor 1 except that the hardening agent HPC404 was replaced by 4 g of Aluminum chelate A (W) manufactured by Kawaken Chemical Co., Ltd.

Preparation of Photoreceptor 4

Photoreceptor 4 was prepared in the same manner as in photoreceptor 1 except that the hardening agent HPC404 was replaced by Titanium chelate TC-750 manufactured by Matsumoto Seiyaku Co., Ltd.

Preparation of Photoreceptor 5

Photoreceptor 5 was prepared in the same manner as in photoreceptor 1 except that the reactive charge transportable substance Exemplified compound B-1 is omitted.

Preparation of Photoreceptor 6

A photoreceptor was prepared until the charge transportation layer in the same manner as in photoreceptor 1.

| <Surface layer> | |
|---|---|
| Silicone hard-coat agent KP-851 (Shin'etsu Kagaku Co., Ltd.) | 182 g |
| Reactive charge transportable substance (Exemplified compound B-1) | 15 g |
| Antioxidant (Exemplified compound 2-1) | 0.75 g |
| 2-propanol | 75 g |
| 3% acetic acid | 5 g |

The above-mentioned were mixed to prepare a resin layer coating liquid. The coating liquid was coated on the foregoing charge transportation layer by a disk quantity regulation coating apparatus so as to form a resin layer with a thickness of 2 μm. The coated layer was thermally hardened by heating for 1 hour at 120° C. Thus Photoreceptor 6 was prepared.

Preparation of Photoreceptor 7

A photoreceptor was prepared until charge transportation layer in the same manner as in photoreceptor 1.

| <Surface layer> | |
|---|---|
| Polycarbonate Z300 (Mitsubishi Gas Kagaku Co., Ltd.) | 660 g |
| Charge transportable substance (N-(4-methylphenyl)-N-{4-(β-phenylstylyl)phenyl}-p-toluidine) | 360 g |
| Antioxidant (Exemplified compound 2-1) | 18 g |
| Phenyltrimethoxysilane | 33 g |
| Hydrochloric acid | 1 g |
| 1,3-dioxoran | 2800 ml |

The above-mentioned were mixed to prepare a resin layer coating liquid. The coating liquid was coated on the foregoing charge transportation layer by a disk quantity regulation coating apparatus so as to form a resin layer with a thickness of 5 μm. The coated layer was thermally hardened by heating for 1 hour at 120° C. Thus Photoreceptor 7 was prepared which has a hybrid surface layer comprising polycarbonate and polysiloxane.

Evaluation

Photoreceptors were each installed in a digital copying machine Konica 7075, manufactured by Konica Corp., for evaluating the above-prepared photoreceptors. The copying machine has processes of charging, laser exposing, reversal developing, static transferring, separating claw, cleaning blade and assistance cleaning brush roller. The cleaning suitability and the image quality were evaluated by copying an original image chat to A4 size neutral paper. The original image chart includes a character image with a pixel ratio of 7%, a portrait photograph, a solid white image and a solid black image each occupying ¼ area of the original chart. The operation was continuously performed for 200,000 copies under an extremely serious condition at a temperature of 30° C. and a relative humidity of 80%. The copied image was evaluated with respect to the halftone, solid white and solid black images. The abrasive wearing amount of the photoreceptor was calculated from the difference of the initial layer thickness and the thickness after copying of 200,000 sheets. The cleaning suitability was evaluated by copying a chart with A3 size having a solid black image and solid white image in an area ratio of 4:1 after copying of 100,000 and 200,000 sheets. The copying was performed each 10 sheets, and the cleaning suitability was evaluated by occurrence of cleaning fault in the solid white area of the copied image. For evaluating the turn over of the cleaning blade, times of occurrence of turn over were counted. Moreover, the starting torque of the cleaning blade was measured after copying of 200,000 sheets.

The absolute reflective density of the image was measured by RD-918, manufactured by Macbeth Co., Ltd., and the density of the image of the initial copy and that of the image of 100,000th copy were compared. The fog is evaluated by relative reflective density of the soil white area measured by RD-918 when the reflective density of the paper was set at 0 and the density of the image of the initial copy and that of the image of 10,000th copy were compared.

Evaluation Criteria

Image density (relative reflective density measured by Macbeth RD-918 when the reflective density of the paper was set at 0)

A: 1.2 or more; Good

B: Less than 1.2 to 1.0; Acceptable for practical use

D: less than 1.0; Unacceptable for practical use Resolving power (ranked by the readability of the character image)

B: There is no difference between the initial copy and the 200,000$^{th}$ copy.

C: Slight degradation of the resolving power was observed in the halftone image of the 200,000$^{th}$ copy.

D: Considerable degradation of the resolving power was observed on the 200,000$^{th}$ copy.

Cleaning ability (10 sheets of A3 size copies were continuously made after 100,00$^{th}$ and 200,00$^{th}$ copying and the judgment was performed on the occurrence of cleaning fault.)

A: No slipping was occurred until the 200,000$^{th}$ copy.

B: No slipping was occurred until the 100,000$^{th}$ copy.

D: Slipping was occurred before the 100,000$^{th}$ copying.

Blade turn over (ranked by the occurrence of the turn over during the 200,000 copying)

A: No turn over was occurred until the 200,000$^{th}$ copy.

B: Turn over was slightly occurred

D: Turn over was occurred

Staring Torque of Cleaning Blade

The drum cartridge after copying of 200,000 sheets was tested. The starting torque of the drum shaft of the copy machine was measured by a torque gage Model 6BTG, manufactured by Tohonichi Co., Ltd., connected to the shaft. The measurement was repeated by 5 times and the torque was expressed by the average of thus obtained five values.

Abrasive Wearing Amount of Photoreceptor

The abrasive wearing amount of the photoreceptor was determined by the different of the average layer thickness of the photoreceptor measured at the initial time and after 200,000 sheets of copying.

Measurement of Layer Thickness

The layer thickness of the photoreceptor was determined by the average value of the thickness measured at randomly selected 10 points in the uniform area of the photoreceptor layer. The measurement was performed by eddy current method using a layer thickness meter EDDYS60C manufactured by Helmut Fischer GMBTE Co., Ltd. The abrasive wearing amount was defined by the different of the layer thickness before and after the practical copying test of 200,000 sheets.

Another Evaluation Condition

Evaluation conditions using the forgoing copying machine Konica 7075 other than the above-mentioned were set as follows.

Charging Condition

Charging device: Scorotron Charging device, Initial charging potential was −750 V.

Exposure condition: The exposure amount was set so that the potential at the exposed area was become −50 V.

Developing Condition

DC bias: −550 V

A developer was used which contains a carrier comprised of ferrite core coated with an insulating resin and a toner containing a colored particle comprised of a styrene-acryl resin as the main raw material, a colorant such as carbon black, a charge controlling agent and a low molecular weight polyolefin, and an exterior additive such as silica and titanium oxide.

Transferring Condition

Transferring Electrode: Corona Charging Device Cleaning Condition.

A cleaning blade having a hardness of 70°, a repulsion elasticity of 34%, a thickness of 2 mm and a free length of 9 mm was contacted to the photoreceptor surface by weighting in the counter direction so that the line pressure was 20 g/cm.

Results of the evaluation are shown in Table 1.

TABLE 1

| Photoreceptor No. | Image density | Resolving power | Cleaning ability | Blade turn off | Starting torque (kgf cm) | Abrasive wearing amount of layer thickness (μm) | Remarks |
|---|---|---|---|---|---|---|---|
| 1 | A | B | B | B | 4.8 | 1.4 | Inv. |
| 2 | A | B | B | B | 5.0 | 1.9 | Inv. |
| 3 | A | B | A | A | 4.8 | 0.9 | Inv. |
| 4 | A | B | A | A | 5.0 | 0.8 | Inv. |
| 5 | D | B | B | D | 6.9 | 1.4 | Comp. |
| 6 | B | D | B | D | 9.5 | 0.5 | Comp. |
| 7 | B | C | D | D | 5.8 | 4.1 | Comp. |

Inv.: Inventive,
Comp.: Comparative

As is shown in Table 1, Photoreceptors 1 through 4 each having the resin layer according to the invention are improved in the image quality such as the image density and the resolving power, the cleaning property such as the cleaning suitability and the turning off of blade and the abrasive wearing amount with a good balance. On the other hand, in Photoreceptor 5 without the invention, the charge transportation ability is insufficient and the image density was lowered by the remaining potential, the starting torque is high and the turning off of the blade is occurred.

In Photoreceptor 6, the starting torque is high, the turning off of the blade is occurred and the resolving power is lowered even though the abrasive wearing is small.

The photoreceptors according to the invention are improved in all the image quality, the cleaning suitability and the abrasive wearing amount compared with Photoreceptor 7 using the resin layer of polycarbonate without the invention.

Example 2

Preparation of Photoreceptor 8

A photoreceptor was prepared until the charge transportation layer in the same manner as in Photoreceptor 1.

| <Resin layer> | |
|---|---|
| Silyl group-containing vinyl resin A (solid content: 50%) | 60 g |
| Methyltrimethoxysilane | 70 g |
| Reactive chare transportable compound (Exemplified compound B-1) | 40 g |
| Antioxidant (Exemplified compound 2-1) | 2 g |
| 2-propanol | 150 g |
| 2-butanone | 100 g |
| 3% acetic acid | 10 g |
| Aluminum chelate A (W) (Kawaken Chemical Co., Ltd.) | 10 g |

The above-mentioned were mixed to prepare a resin layer coating liquid. The coating liquid was coated on the foregoing charge transportation layer by a disk quantity regulation coating apparatus so as to form a resin layer with a thickness of 2 μm. The coated layer was thermally hardened by heating for 1 hour at 120° C. to form a siloxane resin layer. Thus Photoreceptor 8 was prepared.

Preparation of Photoreceptor 9

A photoreceptor was prepared until the charge transportation layer in the same manner as in Photoreceptor 1.

| <Resin layer> | |
|---|---|
| Silyl group-containing vinyl resin A (solid content: 50%) | 140 g |
| Methyltrimethoxysilane | 30 g |
| Reactive chare transportable compound (Exemplified compound B-1) | 40 g |
| Antioxidant (Exemplified compound 2-1) | 2 g |
| 2-propanol | 150 g |
| 2-butanone | 100 g |
| 3% acetic acid | 10 g |
| Aluminum chelate A (W) (Kawaken Chemical Co., Ltd.) | 10 g |

The above-mentioned were mixed to prepare a resin layer coating liquid. The coating liquid was coated on the foregoing charge transportation layer by a disk quantity regulation coating apparatus so as to form a resin layer with a thickness of 2 μm. The coated layer was thermally hardened by heating for 1 hour at 120° C. to form a siloxane resin layer. Thus Photoreceptor 9 was prepared.

Preparation of Photoreceptor 10

A photoreceptor was prepared until the charge transportation layer in the same manner as in Photoreceptor 1.

| <Resin layer> | |
|---|---|
| Methyltrimethoxysilane | 60 g |
| 2-propanol | 50 g |
| 3% acetic acid | 10 g |

The above-mentioned were mixed and stirred for 24 hours at 50° C. so as to prepare a solution of oligomer of methyltrimethoxysilane.

| | |
|---|---|
| Methyltrimethoxysilane oligomer solution | 120 g |
| Methyltrimethoxysilane | 10 g |
| Reactive chare transportable compound (Exemplified compound B-1) | 40 g |
| Antioxidant (Exemplified compound 2-1) | 2 g |
| 2-propanol | 100 g |
| 2-butanone | 100 g |
| Aluminum chelate A (W) (Kawaken Chemical Co., Ltd.) | 10 g |

The above-mentioned were mixed to prepare a resin layer coating liquid. The coating liquid was coated on the foregoing charge transportation layer by a disk quantity regulation coating apparatus so as to form a resin layer with a thickness of 2 μm. The coated layer was thermally hardened by heating for 1 hour at 120° C. to form a siloxane resin layer. Thus Photoreceptor 10 was prepared.

Photoreceptors 8 through 10 were evaluated in the same manner as in Example 1.

TABLE 2

| Photo-receptor No. | Image density | Resolv-ing power | Clean-ing ability | Blade turn off | Start-ing torque | Abra-sive wearing amount of layer thick-ness | Re-marks |
|---|---|---|---|---|---|---|---|
| 8 | A | B | A | A | 4.2 | 0.9 | Inv. |
| 9 | A | A | A | A | 3.7 | 1.9 | Inv. |
| 10 | A | A | A | B | 4.8 | 0.7 | Inv. |

Inv.: Inventive

As is shown in Table 2, Photoreceptors 8 through 9 having each the resin layer according to the invention display suitable properties which are improved in the image quality such as the image density and the resolving power and the cleaning property such as the cleaning suitability and the turning off of cleaning blade. On the other hand, the charge transportation ability is insufficient and the image density was lowered by the remaining potential, the starting torque is high and the turning off of the blade is occurred in Photoreceptor 5 without the invention.

Example 21

Preparation of Photoreceptor 21

Photoreceptor 21 was prepared as follows.

Subbing layer, charge generation layer and charge transportation layer were provided in the same way as Example 1.

| (Surface layer: Resin layer according to the invention) | |
|---|---|
| Vinyl Polymer Solution 2A | 100 parts |
| Methylmethoxysilane | 70 parts |
| Dimethyldimethoxysilane | 30 parts |
| i-butyl alcohol | 100 parts |
| Butyl cellosolve | 75 parts |
| Aluminum di-i-propoxyethylacetoacetate | 10 parts |

The above-mentioned were mixed and satisfactorily stirred. Then 30 parts of purified water was dropped into the liquid while stirring into the liquid and reaction was performed at 60° C. for 4 hours. Thereafter, the reacting liquid was cooled by an ordinary temperature and 50 parts of the reactive charge transportable compound B-1 and 5 parts of aluminum triacetylacetonate were added to the liquid. The liquid was stirred to prepare a coating composition. The coating composition was coated on the foregoing charge transportation layer by a disk quantity regulation coating apparatus so as to form a surface layer with a thickness of 3 μm. The coated layer was thermally hardened by heating for 1 hour at 120° C. to form a siloxane resin layer. Thus Photoreceptor 21 having the surface layer according to the invention was prepared.

Preparation of Photoreceptor 22

(Surface Layer: Resin Layer According to the Invention)

Photoreceptor 22 having a resin layer according to the invention as a surface layer was prepared in the same manner as in Photoreceptor 21 except that 2 parts of antioxidant Sanol LS2626, manufactured by Sankyo Co., Ltd., was added to the surface layer coating composition.

Preparation of Photoreceptor 23

(Surface Layer: Resin Layer According to the Invention)

Photoreceptor 23 having a resin layer according to the invention as a surface layer was prepared in the same manner as in Photoreceptor 21 except that the reactive charge transportable compound B-1 in the surface layer coating composition was replaced by B-2.

Preparation of Photoreceptor 24

(Surface Layer: Resin Layer According to the Invention)

Photoreceptor 24 having a resin layer according to the invention as a surface layer was prepared in the same manner as in Photoreceptor 21 except that the reactive charge transportable compound B-1 in the surface layer coating composition was replaced by Si-1.

Preparation of Photoreceptor 25

(Surface Layer: Resin Layer According to the Invention)

Photoreceptor 25 having a resin layer according to the invention as a surface layer was prepared in the same manner as in Photoreceptor 23 except that Vinyl Polymer Solution 2A used in the surface layer was replaced by Vinyl Polymer Solution B.

Preparation of Photoreceptor 26

A photoreceptor was prepared until the charge transportation layer in the same manner as in Photoreceptor 21.

| <Surface layer: resin layer according to the invention> | |
|---|---|
| Vinyl Polymer Solution 2A | 100 parts |
| Methyltrimethoxysilane | 100 parts |
| i-butyl alcohol | 100 parts |
| Butyl cellosolve | 75 parts |
| Aluminum di-i-propoxyethylacetoacetate | 10 parts |

The above-mentioned were mixed and satisfactorily stirred. Then 30 parts of purified water was dropped while stirring into the liquid and reaction was performed at 60° C. for 4 hours. Thereafter, the reacting liquid was cooled by an ordinary temperature and 50 parts of the reactive charge transportable compound B-1 and 5 parts of titanium chelate TC-750, manufactured by Matsumoto Seiyaku Co., Ltd., were added the liquid. The liquid was stirred to prepare a coating composition. The coating composition was coated on the foregoing charge transportation layer by a disk quantity regulation coating apparatus so as to form a surface layer with a thickness of 3 μm. The coated layer was thermally hardened by heating for 1 hour at 120° C. to form a siloxane resin layer. Thus Photoreceptor 26 having the surface layer according to the invention was prepared.

Preparation of Photoreceptor 27

A photoreceptor was prepared until the charge transportation layer in the same manner as in Photoreceptor 21.

| <Surface layer: resin layer according to the invention> | |
|---|---|
| Vinyl Polymer Solution 2A | 100 parts |
| Methyltrimethoxysilane | 80 parts |
| γ-glycidoxypropyltrimethoxysilane | 20 parts |
| i-butyl alcohol | 100 parts |
| Butyl cellosolve | 75 parts |
| Aluminum di-i-propoxyethylacetoacetate | 10 parts |

The above-mentioned were mixed and satisfactorily stirred. Then 30 parts of purified water was dropped while stirring into the liquid and reaction was performed at 60° C. for 4 hours. Thereafter, the reacting liquid was cooled by an ordinary temperature and 50 parts of the reactive charge transportable compound B-1 and 5 parts of aluminum triacetylacetonate was added the liquid. The liquid was stirred to prepare a coating composition. The coating composition was coated on the foregoing charge transportation layer by a disk quantity regulation coating apparatus so as to form a surface layer with a thickness of 3 Rm. The coated layer was thermally hardened by heating for 1 hour at 120° C. to form a siloxane resin layer. Thus Photoreceptor 27 having the surface layer according to the invention was prepared.

Preparation of Photoreceptor 28 (Comparative Photoreceptor)

Photoreceptor 28 was prepared in the same manner as in Photoreceptor 21 except that the surface layer was omitted and the photoreceptor was subjected to drying by heating at 120° C. for 1 hour.

Evaluation

Photoreceptors were each installed in a digital copying machine Konica 7075, manufactured by Konica Corp., for evaluating the above-prepared photoreceptors. The copying machine has processes of charging, laser exposing, reversal developing, static transferring, separating claw, cleaning blade and assistance cleaning brush roller. The cleaning suitability and the image quality were evaluated by copying an original image chat to A4 size neutral paper. The original image chart includes a character image with a pixel ratio of 7%, a portrait photograph, a solid white image and a solid black image each occupying ¼ area of the original chart. The operation was continuously performed for 200,000 copies under an extremely serious condition at a temperature of 30° C. and a relative humidity of 80%. The copied image was evaluated with respect to the halftone, solid white and solid black images. The abrasive wearing amount of the photoreceptor was calculated from the difference of the initial layer thickness and the thickness after copying of 200,000 sheets. The cleaning suitability was evaluated by copying a chart with A3 size having a solid black image and solid white image in an area ratio of 4:1 after copying of 200,000 sheets. The copying was performed each 10 sheets, and the cleaning suitability was evaluated by occurrence of cleaning fault in the solid white area of the copied image. For evaluating the turn over of the cleaning blade, times of occurrence of turn over were counted. Moreover, the starting torque of the cleaning blade was measured after copying of 100,000, 150,000 and 200,000 sheets. The absolute reflective density of the image was measured by RD-918, manufactured by Macbeth Co., Ltd., and the density of the image of the copy and that of the image of 100,000th, 150,000th, and 200,000th copy were compared.

Evaluation Criteria

Image Density (Relative Reflective Density Measured by Macbeth RD-918 when the Reflective Density of the Paper was Set at 0)

A: 1.2 or more; Good

B: Less than 1.2 to 1.0; Acceptable for practical use

D: less than 1.0; Unacceptable for practical use Resolving power (ranked by the readability of the character image)

B: There is no difference between the initial copy and the 200,000$^{th}$ copy.

C: Slight degradation of the resolving power was observed in the halftone image of the 200,000$^{th}$ copy.

D: Considerable degradation of the resolving power was observed on the 200,000$^{th}$ copy.

Cleaning ability (10 sheets of A3 size copies were continuously made after 100,00$^{th}$ and 200,00$^{th}$ copying and the judgment was performed on the occurrence of cleaning fault.)

A: No slipping was occurred until the 200,000$^{th}$ copy.

B: No slipping was occurred until the 100,000$^{th}$ Copy.

D: Slipping was occurred before the 100.000$^{th}$ copying. Blade turn over (ranked by the occurrence of the turn over during the 200,000 copying)

A: No turn over was occurred until the 200,000th copy.

B: Turn over was slightly occurred

D: Turn over was occurred

Staring Torque of Cleaning Blade

The drum cartridge after copying of 200,000 sheets was tested. The starting torque of the drum shaft of the copy machine was measured by a torque gage Model 6BTG, manufactured by Tohonichi Co., Ltd., connected to the shaft. The measurement was repeated by 5 times and the torque was expressed by the average of thus obtained five values.

Measurement of Layer Thickness

The layer thickness of the photoreceptor was determined by the average value of the thickness measured at randomly selected 10 points in the uniform area of the photoreceptor layer. The measurement was performed by eddy current method using a layer thickness meter EDDY560C manufactured by Helmut Fischer GMBTE Co., Ltd. The abrasive wearing amount was defined by the different of the layer thickness before and after the practical copying test of 200,000 sheets.

The other condition was the same as Example 1. The result s summarized in Table 21.

TABLE 21

| Photoreceptor No. | Image density | Resolving power | Cleaning ability | Blade turn off | Starting torque (J) | Abrasive wearing amount of layer thickness (μm) | Remarks |
|---|---|---|---|---|---|---|---|
| 21 | A | B | B | A | 0.57 | 1.4 | Inv. |
| 22 | A | B | A | A | 0.55 | 1.2 | Inv. |
| 23 | A | B | B | A | 0.54 | 1.3 | Inv. |
| 24 | A | B | B | B | 0.69 | 2.5 | Inv. |
| 25 | A | B | B | B | 0.58 | 1.7 | Inv. |
| 26 | A | B | B | B | 0.56 | 1.9 | Inv. |
| 27 | A | B | A | A | 0.45 | 0.8 | Inv. |
| 28 | B | B | D | B | 0.54 | 5.7 | Comp. |

Inv.: Inventive,
Comp.: Comparative

As is shown in Table 21, Photoreceptors 21 through 27 each having the resin layer according to the invention are improved in the image quality such as the image density and the resolving power, the cleaning property such as the cleaning suitability and the turning off of blade and the abrasive wearing amount with a good balance. On the other hand, in Photoreceptor 27 without the invention, the charge transportation ability is insufficient and the image density was lowered by the remaining potential, the starting torque is high and the turning off of the blade is occurred.

In Photoreceptor 28, the starting torque is high, the turning off of the blade is occurred and the resolving power is lowered even though the abrasive wearing is small.

Example 31

Preparation of Photoreceptor 31

Photoreceptor 21 was prepared as follows.

Subbing layer, charge generation layer and charge transportation layer were provided in the same way as Example 1.

| <Surface layer: resin layer according to the invention> | |
|---|---|
| Silyl group-containing Vinyl Polymer Solution A | 100 g |
| Methyltrimethoxysilane | 70 g |
| 3-glycidoxypropyltrimethoxysilane | 30 g |
| 2-butyl alcohol | 100 g |
| Butyl cellosolve | 75 g |
| Aluminum di-i-propoxyethylacetoacetate | 10 g |

The above-mentioned were mixed and satisfactorily stirred. Then 30 parts of water was dropped into the liquid while stirring and reaction was progressed at 60° C. for 4 hours. Thereafter, the reacting liquid was cooled by an ordinary temperature and 10 g of 2-propyl alcohol solution with a solid content of 15% by weight of dioctyl-tin dimareate ester, 50 g of the reactive charge transportable compound B-1 were added to the liquid. The liquid was stirred to prepare a coating composition. The coating composition was coated on the foregoing charge transportation layer by a disk quantity regulation coating apparatus so as to form a resin layer with a thickness of 3 μm. The coated layer was thermally hardened by heating for 1 hour at 120° C. Thus Photoreceptor 31 was prepared which has the resin layer containing the organic polymer component, the siloxane condensate component and the charge transportation component according to the invention.

Preparation of Photoreceptor 32

Photoreceptor 32 having a resin layer which contains the organic polymer component, the siloxane component and the charge transportation component was prepared in the same manner as in Photoreceptor 31 except that the charge transportable compound, Exemplified compound B-1 in the surface layer, was replaced by Exemplified compound Si-1.

Preparation of Photoreceptor 33

Photoreceptor 33 having a resin layer which contains the organic polymer component, the siloxane component and the charge transportation component was prepared in the same manner as in Photoreceptor 31 except that titanium chelate TC-750, manufactured by Matsumoto Seiyaky Co., Ltd., was used as a hardening agent in the surface layer in place of dioctyl-tin dimareate ester.

Preparation of Photoreceptor 34

Photoreceptor 33 having a resin layer which contains the organic polymer component, the siloxane component and the charge transportation component was prepared in the same manner as in Photoreceptor 31 except that 3-glycidoxypropyl-trimethoxysilane was replaced by 2-(3, 4-epoxycyclohexyl)-trimethoxysilane.

Preparation of Photoreceptor 35

A photoreceptor was prepared in the same manner as in Photoreceptor 31 until the charge transportation layer.

| <Surface layer: resin layer according to the invention> | |
|---|---|
| Methyltrimethoxysilane | 70 g |
| 3-glycidoxypropyltrimethoxysilane | 30 g |
| 2-propanol | 50 g |
| 3% acetic acid | 10 g |

The above-mentioned were mixed and stirred for 24 hours at 50° C. to prepare a solution of an oligomer of methyltrimethoxysilane and 3-glycidoxypropyltrimethoxysilane

| | |
|---|---|
| Methyltrimethoxysilane oligomer solution | 160 g |
| Tetramethoxysilane | 10 g |
| Silyl group-containing vinyl polymer A (solid content: 50% by weight) | 60 g |
| Reactive charge transportable compound (Exemplified compound B-1) | 40 g |
| Antioxidant (Exemplified compound 2-1) | 2 g |
| 2-propanol | 100 g |
| 2-butanone | 100 g |
| Aluminum chelate A (W) (Kawaken Chemical Co., Ltd.) | 10 g |

The above-mentioned were mixed to prepare a surface layer coating composition. The coating composition was coated on the foregoing charge transportation layer by a disk quantity regulation coating apparatus so as to form a surface layer with a thickness of 2 μm. The coated layer was thermally hardened by heating for 1 hour at 120° C. Thus Photoreceptor 35 was prepared which has resin layer containing the organic polymer component, the siloxane condensate component and the charge transportation component.

Comparative Example

Preparation of Photoreceptor 36

<Surface Layer: Comparative Resin Layer>

Photoreceptor 36 was prepared in the same manner as in Photoreceptor 31 except that the reactive charge transportable compound, Exemplified compound B-1, in the surface layer was omitted.

Preparation of Photoreceptor 37

A photoreceptor was prepared until the charge transportation layer in the same manner as in Photoreceptor 31.

| <Surface layer: comparative resin layer> | |
|---|---|
| Silicone hard coat agent KP-851 (ShinEtsu Kagaku Co., Ltd.) | 182 g |
| Reactive charge transportable compound (Exemplified compound B-1) | 15 g |
| Antioxidant (Exemplified compound 2-1) | 0.75 g |
| 3% acetic acid | 5 g |

The above mentioned were mixed to prepare a surface layer coating composition. The coating composition was coated on the foregoing charge transportation layer by a disk quantity regulation coating apparatus so as to form a surface layer with a thickness of 2 μm. The coated layer was thermally hardened by heating for 1 hour at 120° C. Thus Photoreceptor 38 having a siloxane resin layer without the invention was prepared.

The same test as Example 1 was conducted. The result is summarized in Table 31.

TABLE 31

| Photoreceptor No. | Image density | Resolving power | Cleaning ability | Blade turn off | Starting torque (J) | Abrasive wearing amount of layer thickness (μm) | Remarks |
|---|---|---|---|---|---|---|---|
| 31 | A | B | B | A | 0.35 | 0.8 | Inv. |
| 32 | A | B | B | B | 0.36 | 1.0 | Inv. |
| 33 | A | B | B | B | 0.36 | 0.9 | Inv. |

TABLE 31-continued

| Photo-receptor No. | Image density | Resol-ving power | Clean-ing ability | Blade turn off | Start-ing torque (J) | Abra-sive wearing amount of layer thick-ness (μm) | Re-marks |
|---|---|---|---|---|---|---|---|
| 34 | A | B | B | A | 0.37 | 0.8 | Inv. |
| 35 | A | B | A | A | 0.34 | 0.5 | Inv. |
| 36 | D | D | B | D | 0.40 | 1.2 | Inv. |
| 37 | B | B | D | D | 0.52 | 1.2 | Comp. |

Inv.: Inventive,
Comp.: Comparative

As is shown in Table 31, Photoreceptors 31 through 35 each having the resin layer according to the invention are improved in the image quality such as the image density and the resolving power, the cleaning property such as the cleaning suitability and the turning off of blade and the abrasive wearing amount with a good balance. On the other hand, in Photoreceptor 36 employing resin having the charge transportable component, the charge transportation ability is insufficient and the image density was lowered by the remaining potential, the starting torque is high and the turning off of the blade is occurred.

Example 41

Synthesizing Example of Resin Containing Silyl Group (4A)

In a reaction vessel equipped with reflux condenser and a mixer 70 parts of methyl methacrylate, 25 parts of γ-methacryloyloxypropyl-trimethoxysilane, 4-methacryloyloxy-1,2,2,6,6-pentamethylpiperidine, 5 parts of methacryl-2,2,2,-trifluoroethyl ester, 29 parts of n-butyl acrylate as monomers are added and dissolved in 150 parts of 2-propanol, 50 parts of 2-buthanone and 25 pars of methanol. The mixture was heated by 80° C. while stirring. A solution of 4 parts of azo-bis-iso-valeronitrile dissolved in 10 parts of tetrahydrofuran was dropped into the mixture taking 30 minutes. Vinyl resin containing silyl group 4A with a solid content of 40% was obtained after reaction at 80° C. for 4 hours.

Synthesizing Example of Resin Containing Silyl Group (4B)

In a reaction vessel equipped with reflux condenser and a mixer 20 parts of γ-methacryloyloxypropyl-trimethoxysilane, 70 pats of methylmethacrylate, 20 parts of methacryl-2,2,2,-trifluoroethyl ester, 35 parts of n-butyl acrylate, 5 parts of acrylic acid, 2 parts of 2-t-butyl-6-(3-t-butyl2-hydroxy-5 -methylbenzyl)-4-methylphenylacrylate, 13 parts of 2-hydroxyethyl methacrylate, 1 part of 1,1,1-trimethylaminemethacrylimide, 150 parts of 2-propanol, 50 parts of 2-buthanone and 25 parts of methanol are added and mixed. The mixture was heated by 80° C. while stirring. A solution of 4 parts of azo-bis-iso-valeronitrile dissolved in 10 parts of xylene was dropped into the mixture taking 30 minutes. Vinyl resin containing silyl group 4B with a solid content of 40% was obtained after reaction at 80° C. for 5 hours.

Preparation of Photoreceptor 41

The photoreceptor 41 was prepared in the following way.

Subbing layer, charge generation layer and charge transportation layer were provided in the same way as Example 1.

| <Surface layer> | |
|---|---|
| Polymer solution 4A | 100 parts |
| Methyltrimethoxysilane | 70 parts |
| Dimethyldimethoxysilane | 30 parts |
| i-butyl alcohol | 100 parts |
| Butyl cellosolve | 75 parts |
| Aluminum di-i-propoxyethylacetoacetate | 10 parts |

The above-mentioned were mixed and stirred, and 30 parts of purified water was dropped into the mixture. Then the reaction was performed at 60° C. for 4 hours.

Then the reaction liquid was cooled by an ordinary temperature, and 50 parts of the charge transportable compound B-1 and 5 parts of aluminum trisacetylacetnate were added to the liquid. The liquid was stirred to prepare a coating composition. The coating composition was coated on the foregoing charge transportation layer by a disk quantity regulation coating apparatus so as to form a surface layer with a thickness of 3 μm. The coated layer was thermally hardened by heating for 1 hour at 120° C. Thus Photoreceptor 41 was prepared.

Preparation of Photoreceptor 42

Photoreceptor 42 was prepared in the same manner as in Photoreceptor 41 except that 2,5 parts of antioxidant LS 2626, manufactured by Sankyo Co., Ltd., was added to the surface layer.

Preparation of Photoreceptor 43

Photoreceptor 43 was prepared in the same manner as in Photoreceptor 41 except that the charge transportable compound B-1 in the surface layer coating composition was replaced by B-2.

Preparation of Photoreceptor 44

Photoreceptor 44 was prepared in the same manner as in Photoreceptor 41 except that the charge transportable compound B-1 in the surface layer coating composition was replaced by Si-1.

Preparation of Photoreceptor 45

Photoreceptor 45 was prepared in the same manner as in Photoreceptor 41 except that Polymer Solution 4A in the surface layer coating composition was replaced by Polymer Solution 4B.

Preparation of Photoreceptor 46

A photoreceptor was prepared until the charge transportation layer in the same manner as in Photoreceptor 41.

| <Surface layer> | |
|---|---|
| Polymer solution 4A | 100 parts |
| Methyltrimethoxysilane | 100 parts |
| i-butyl alcohol | 100 parts |
| Butyl cellosolve | 75 parts |
| Aluminum di-i-propoxyethylacetoacetate | 10 parts |

The above-mentioned were mixed and satisfactorily stirred. Then 30 parts of purified water was dropped into the liquid while stirring and the reaction was performed at 60° C. for 4 hours. Thereafter, the reacting liquid was cooled by an ordinary temperature and 50 parts of the reactive charge transportable compound B-1, 5 parts of hardener T-5020, manufactured by JSR Co., Ltd., and 2.5 parts of antioxidant LS2626, manufactured by Sankyo Co., Ltd., were added to the liquid. The liquid was stirred to prepare a coating composition. The coating composition was coated on the foregoing charge transportation layer by a disk quantity regulation coating apparatus so as to form a surface layer with a thickness of 3 μm. The coated layer was thermally hardened by heating for 1 hour at 120° C. to form a siloxane resin layer. Thus Photoreceptor 46 was prepared.

Preparation of Photoreceptor 47

A photoreceptor was prepared until the charge transportation layer in the same manner as in Photoreceptor 41.

| <Surface layer> | |
|---|---|
| Polymer Solution aA | 100 parts |
| Methylmethoxysilane | 80 parts |
| γ-glycidoxypropyltrimethoxysilane | 20 parts |
| i-butyl alcohol | 100 parts |
| Butyl cellosolve | 75 parts |
| Aluminum di-i-propoxyethylacetoacetate | 10 parts |

The above-mentioned were mixed and satisfactorily stirred. Then 30 parts of purified water was dropped into the liquid while stirring and the reaction was performed at 60° C. for 4 hours. Thereafter, the reacting liquid was cooled by an ordinary temperature and 50 parts of the reactive charge transportable compound B-1, 5 parts of aluminum trisacetylacetonate were added to the liquid. The liquid was stirred to prepare a coating composition. The coating composition was coated on the foregoing charge transportation layer by a disk quantity regulation coating apparatus so as to form a surface layer with a thickness of 3 μm. The coated layer was thermally hardened by heating for 1 hour at 120° C. to form a siloxane resin layer. Thus Photoreceptor 47 was prepared.

Preparation of Photoreceptor 48 (Comparative Photoreceptor)

A photoreceptor was prepared until the charge transportation layer in the same manner as in Photoreceptor 41.

| <Surface layer> | |
|---|---|
| Fluorine hybrid sample FPX-30G (solid content: 30%, JSR Co., Ltd.) | 100 parts |
| Hardening agent T-5020 (JSR Co., Ltd.) | 10 parts |
| Charge transportable compound B-1 | 20 parts |
| i-butyl alcohol | 25 parts |
| Butyl cellosolve | 5 parts |
| Methyl ethyl ketone | 20 parts |

The above-mentioned were mixed and satisfactorily stirred to prepare a coating composition. The coating composition was coated on the foregoing charge transportation layer by a disk quantity regulation coating apparatus so as to form a surface layer with a thickness of 2 μm. The coated layer was thermally hardened by heating for 1 hour at 120° C. to form a siloxane resin layer. Thus Photoreceptor 48 having no organic polymer component was prepared.

Preparation of Photoreceptor 49 (Comparative Photoreceptor)

Photoreceptor 49 was prepared in the same manner as in Photoreceptor 41 except that Polymer Solution 4C was used in place of Polymer Solution 4A.

Preparation of Photoreceptor 410 (Comparative Photoreceptor)

Photoreceptor 410 was prepared in the same manner as in Photoreceptor 41 except that the surface layer was omitted and heating and drying were performed at 120° C. for 1 hour. The same test was conducted as Example 1. The result is summarized in Table 41.

TABLE 41

| Photoreceptor No. | Image density | Resolving power | Cleaning ability | Blade turn off | Starting torque (J) | Abrasive wearing amount of layer thickness (μm) | Remarks |
|---|---|---|---|---|---|---|---|
| 41 | B | B | B | B | 0.49 | 1.4 | Inv. |
| 42 | A | B | B | A | 0.45 | 1.0 | Inv. |
| 43 | B | B | B | B | 0.44 | 1.5 | Inv. |
| 44 | B | B | B | B | 0.49 | 1.8 | Inv. |
| 45 | B | B | B | B | 0.48 | 1.7 | Inv. |
| 46 | B | B | B | B | 0.46 | 2.7 | Inv. |
| 47 | A | B | A | A | 0.35 | 0.7 | Inv. |
| 48 | B | B | B | C | 0.56 | 2.5 | Comp. |

Inv.: Inventive,
Comp.: Comparative

As is shown in Table 41, Photoreceptors 41 through 47 each having the resin layer according to the invention are improved in the image quality such as the image density and the resolving power, the cleaning property such as the cleaning suitability and the turning off of blade and the abrasive wearing amount with a good balance. On the other hand, in Photoreceptor 48 employing resin having the charge transportable component, the charge transportation ability is insufficient and the image density was lowered by the remaining potential, the starting torque is high and the turning off of the blade is occurred.

The photoreceptors according to the invention are improved in all the image quality, the cleaning suitability and the abrasive wearing amount compared with Photoreceptor 39 using the resin layer containing polycarbonate.

What is claimed is:

1. A photoreceptor for forming an electrostatic latent image comprising a support and, provided thereon, a photosensitive layer and a resin layer wherein a resin of the resin layer comprises an organic polymer component, a siloxane component and a charge transportable component.

2. The photoreceptor of claim 1, wherein the organic polymer component comprises a vinyl resin, a polyester resin or a polycarbonate resin.

3. The photoreceptor of claim 1, wherein the resin comprises an anti-oxidant component.

4. The photoreceptor of claim 3, wherein the anti-oxidant component comprises a hindered amine group or a hindered phenol group.

5. The photoreceptor of claim 3, wherein the anti-oxidant component comprises a hindered amine group.

6. The photoreceptor of claim 5, wherein the anti-oxidant component comprises a piperidine group.

7. The photoreceptor of claim 3, wherein the anti-oxidant component comprises a hindered phenol group.

8. The photoreceptor of claim 1, wherein the resin comprises an epoxy group or an open ring group thereof.

9. The photoreceptor of claim 1, wherein the siloxane component comprises an epoxy group or an open ring group thereof.

10. The photoreceptor of claim 1, wherein the resin comprises a fluorine atom.

11. The photoreceptor of claim 1, wherein the organic polymer component comprises a vinyl monomer containing a fluorine atom as a recurring unit.

12. The photoreceptor of claim 1, wherein weight ratio of the charge transportable component to sum of the organic polymer component and the siloxane component in the resin is from 1:0.01 to 1:20.

13. The photoreceptor of claim 12, wherein the weight ratio of the charge transportable component to the sum of the organic polymer component and the siloxane component in the resin is from 1:0.01 to 1:10.

14. The photoreceptor of claim 1, wherein the resin layer contains a metal chelate compound.

15. The photoreceptor of claim 1, wherein the organic polymer component is thermoplastic organic polymer component.

16. The photoreceptor of claim 14, wherein the metal chelate compound is an aluminum or titanium chelate compound.

17. The photoreceptor of claim 1, wherein the resin layer is a surface layer.

* * * * *